US009711848B2

(12) United States Patent
Kato et al.

(10) Patent No.: US 9,711,848 B2
(45) **Date of Patent: *Jul. 18, 2017**

(54) ANTENNA DEVICE AND COMMUNICATION TERMINAL APPARATUS

(71) Applicant: Murata Manufacturing Co., Ltd., Nagaokakyo-shi, Kyoto-fu (JP)

(72) Inventors: Noboru Kato, Nagaokakyo (JP); Kenichi Ishizuka, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 132 days.

This patent is subject to a terminal disclaimer.

(21) Appl. No.: 14/681,222

(22) Filed: Apr. 8, 2015

(65) Prior Publication Data

US 2015/0214611 A1 Jul. 30, 2015

Related U.S. Application Data

(63) Continuation of application No. 13/218,501, filed on Aug. 26, 2011, now Pat. No. 9,030,371, which is a (Continued)

(30) Foreign Application Priority Data

Jan. 19, 2010 (JP) ..... 2010-009513
Apr. 21, 2010 (JP) ..... 2010-098312

(Continued)

(51) Int. Cl.

| | |
|---|---|
| ***H01Q 5/00*** | (2015.01) |
| ***H01Q 1/50*** | (2006.01) |
| ***H01P 1/203*** | (2006.01) |
| ***H01P 1/213*** | (2006.01) |

(Continued)

(52) U.S. Cl.

CPC ..... *H01Q 1/50* (2013.01); *H01P 1/20345* (2013.01); *H01P 1/2135* (2013.01); *H01Q 5/335* (2015.01);

(Continued)

(58) Field of Classification Search

CPC ..... H01Q 1/50; H01Q 5/314; H01Q 5/328; H01Q 5/335; H01Q 5/50; H04B 1/0458;

(Continued)

(56) References Cited

U.S. PATENT DOCUMENTS 2,141,573 A * 12/1938 Vogt ..... H01F 21/04 333/180
6,937,115 B2 * 8/2005 Perreault ..... H03H 7/0115 333/172

(Continued)

OTHER PUBLICATIONS

McLyman, Transformer and Inductor Design Handbook, 2004, Marcel Dekker Inc, 3rd edition, Chapter 17.*

(Continued)

*Primary Examiner* — Tho G Phan
*Assistant Examiner* — Patrick Holecek
(74) *Attorney, Agent, or Firm* — Keating & Bennett, LLP

(57) ABSTRACT

An antenna device includes an antenna element and an impedance converting circuit connected to the antenna element. The impedance converting circuit is connected to a power-supply end of the antenna element. The impedance converting circuit is interposed between the antenna element and a power-supply circuit. The impedance converting circuit includes a first inductance element connected to the power-supply circuit and a second inductance element coupled to the first inductance element. A first end and a second end of the first inductance element are connected to the power-supply circuit and the antenna, respectively. A first end and a second end of the second inductance element are connected to the antenna element and ground, respectively.

18 Claims, 26 Drawing Sheets

Related U.S. Application Data continuation of application No. PCT/JP2011/050884, filed on Jan. 19, 2011.

(30) Foreign Application Priority Data

| | | |
|---|---|---|
| Apr. 21, 2010 | (JP) | 2010-098313 |
| Aug. 11, 2010 | (JP) | 2010-180088 |
| Sep. 17, 2010 | (JP) | 2010-209295 |
| Jan. 19, 2011 | (JP) | 2011-008534 |

(51) Int. Cl.

| | |
|---|---|
| ***H01Q 9/30*** | (2006.01) |
| ***H01Q 5/335*** | (2015.01) |
| ***H01Q 5/364*** | (2015.01) |
| *H01F 17/00* | (2006.01) |

(52) U.S. Cl.

CPC ..... *H01Q 5/364* (2015.01); *H01Q 9/30* (2013.01); *H01F 17/0013* (2013.01)

(58) Field of Classification Search

CPC ... H04B 3/16; H03H 5/02; H03H 7/09; H03H 7/38; H03H 7/303; H03H 2007/386

See application file for complete search history.

(56) References Cited

U.S. PATENT DOCUMENTS

| | | | | |
|---|---|---|---|---|
| 7,088,307 | B2 * | 8/2006 | Imaizumi | H03H 7/38 333/33 |
| 7,969,270 | B2 * | 6/2011 | Berke | H01F 19/04 336/182 |

OTHER PUBLICATIONS

Kate et al., "Antenna Device and Communication Terminal Apparatus", U.S. Appl. No. 13/218,501, filed Aug. 26, 2011.

* cited by examiner

35

ANTENNA DEVICE AND COMMUNICATION TERMINAL APPARATUS

BACKGROUND OF THE INVENTION

1. Field of the Invention

The present invention relates to an antenna device and a communication terminal apparatus including the same and particularly to an antenna device that achieves matching in a wide frequency band.

2. Description of the Related Art

In recent years, communication terminal apparatuses, such as portable phones, may require compatibility with communication systems, such as a GSM (Global System for Mobile Communication), DCS (Digital Communication System), PCS (Personal Communication Services), and UMTS (Universal Mobile Telecommunications System), as well as a GPS (Global Positioning System), a wireless LAN, Bluetooth (registered trademark), and so on. Thus, antenna devices for such communication terminal apparatuses are required to cover a wide frequency band of 800 MHz to 2.4 GHz.

The antenna devices for a wide frequency band typically have a wideband matching circuit including an LC parallel resonant circuit or an LC series resonant circuit, as disclosed in Japanese Unexamined Patent Application Publication No. 2004-336250 and Japanese Unexamined Patent Application Publication No. 2006-173697. Also, known examples of the antenna devices for a wide frequency band include tunable antennas as disclosed in Japanese Unexamined Patent Application Publication No. 2000-124728 and Japanese Unexamined Patent Application Publication No. 2008-035065.

However, since each of the matching circuits disclosed in Japanese Unexamined Patent Application Publication No. 2004-336250 and Japanese Unexamined Patent Application Publication No. 2006-173697 includes multiple resonant circuits, the insertion loss in the matching circuit is likely to increase and there are cases in which a sufficient gain is not obtained.

On the other hand, since the tunable antennas disclosed in Japanese Unexamined Patent Application Publication No. 2000-124728 and Japanese Unexamined Patent Application Publication No. 2008-035065 require a circuit for controlling a variable capacitance element, that is, a switching circuit for switching the frequency band, the circuit configuration is likely to be complicated. Also, since loss and distortion in the switching circuit are large, there are cases in which a sufficient gain is not obtained.

SUMMARY OF THE INVENTION

In view of the foregoing, preferred embodiments of the present invention provide an antenna device that achieves impedance matching with a power-supply circuit in a wide frequency band and a communication terminal apparatus including the antenna device.

An antenna device according to a preferred embodiment of the present invention includes an antenna element and an impedance converting circuit connected to the antenna element, wherein the impedance converting circuit includes a first inductance element and a second inductance element that is transformer-coupled to the first inductance element such that an equivalent negative inductance component is generated and suppresses or cancels an effective inductance component of the antenna element.

The impedance converting circuit preferably includes a transformer-type circuit in which the first inductance element and the second inductance element are transformer-coupled to each other via a mutual inductance, and when the transformer-type circuit is equivalently transformed into a T-type circuit including a first port connected to a power-supply circuit, a second port connected to the antenna element, a third port connected to ground, a first inductance element connected between the first port and a branch point, a second inductance element connected between the second port and the branch point, and a third inductance element connected between the third port and the branch point, the equivalent negative inductance corresponds to the second inductor.

It is preferable that a first end of the first inductance element is connected to the power-supply circuit, a second end of the first inductance element is connected to ground, a first end of the second inductance element is connected to the antenna element, and a second end of the second inductance element is connected to ground.

It is also preferable that a first end of the first inductance element is connected to the power-supply circuit, a second end of the first inductance element is connected to the antenna element, a first end of the second inductance element is connected to the antenna element, and a second end of the second inductance element is connected to ground.

The first inductance element preferably includes a first coil element and a second coil element, the first coil element and the second coil element are interconnected in series, and conductor winding patterns are arranged so as to define a closed magnetic path.

The second inductance element preferably includes a third coil element and a fourth coil element, the third coil element and the fourth coil element are interconnected in series, and conductor winding patterns are arranged so as to define a closed magnetic path.

The first inductance element and the second inductance element preferably are arranged to couple to each other via a magnetic field and an electric field, and when an alternating current flows in the first inductance element, a direction of a current flowing in the second inductance element as a result of the coupling via the magnetic field and a direction of a current flowing in the second inductance element as a result of the coupling via the electric field are the same.

When an alternating current flows in the first inductance element, a direction of a current flowing in the second inductance element preferably is a direction in which a magnetic wall is generated between the first inductance element and the second inductance element.

The first inductance element and the second inductance element preferably include conductor patterns disposed in a laminate in which multiple dielectric layers or magnetic layers are laminated on each other and the first inductance element and the second inductance element couple to each other inside the laminate.

The first inductance element preferably includes at least two inductance elements connected electrically in parallel, and the two inductance elements have a positional relationship such that the two inductance elements sandwich the second inductance element.

The second inductance element preferably includes at least two inductance elements connected electrically in parallel, and the two inductance elements have a positional relationship such that the two inductance elements sandwich the first inductance element.

According to another preferred embodiment of the present invention, a communication terminal apparatus includes an antenna device including an antenna element, a power-supply circuit, and an impedance converting circuit connected between the antenna element and the power-supply circuit, wherein the impedance converting circuit includes a first inductance element and a second inductance element transformer-coupled to the first inductance element to generate an equivalent negative inductance component that suppresses or cancels an effective inductance component of the antenna element.

According to the antenna device of various preferred embodiments of the present invention, since the impedance converting circuit generates an equivalent negative inductance that suppresses an effective inductance of the antenna element, a resulting or total inductance of the antenna element is reduced. As a result, the impedance frequency characteristic of the antenna device becomes small. Accordingly, it is possible to prevent impedance changes in the antenna device over a wide band and it is possible to achieve impedance matching with a power-supply circuit over a wide frequency band.

Also, according to the communication apparatus of another preferred embodiment of the present invention, the communication apparatus includes the antenna device according to the preferred embodiments described above and thus can be compatible with various communication systems having different frequency bands.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1A:
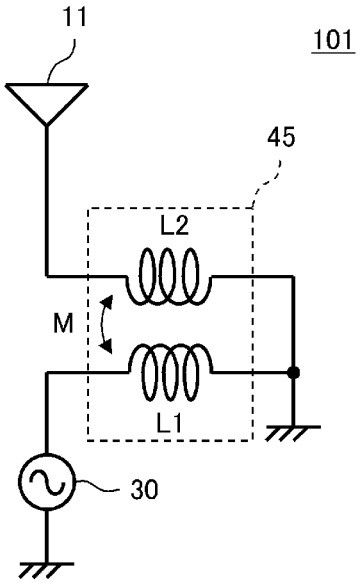
FIG. 1A is a circuit diagram of an antenna device 101 of a first preferred embodiment and FIG. 1B is an equivalent circuit diagram thereof.
Figure 1B:
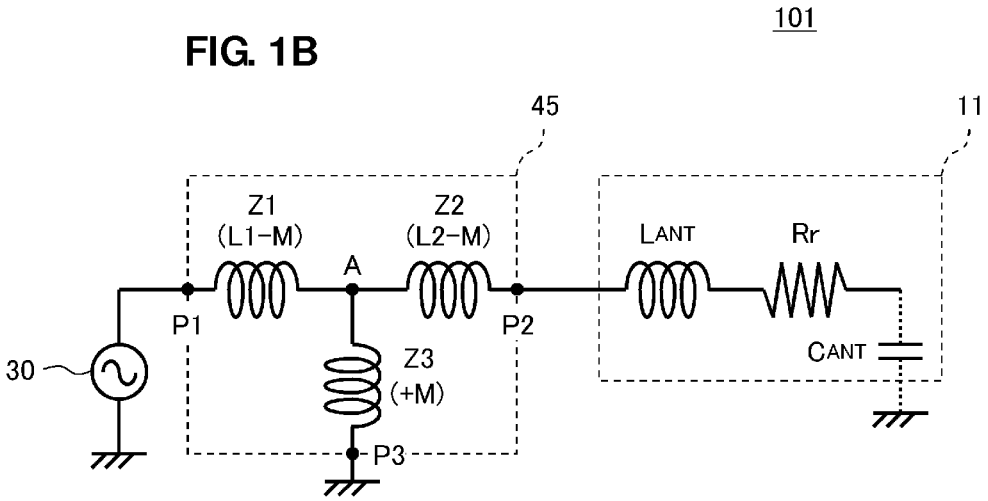

FIG. 1A is a circuit diagram of an antenna device 101 of a first preferred embodiment and FIG. 1B is an equivalent circuit diagram thereof.

As shown in FIG. 1A, the antenna device 101 includes an antenna element 11 and an impedance converting circuit 45 connected to the antenna element 11. The antenna element 11 preferably is a monopole antenna, for example. The impedance converting circuit 45 is connected to a power-supply end of the antenna element 11. The impedance converting circuit 45 is interposed between the antenna element 11 and a power-supply circuit 30. The power-supply circuit 30 preferably is a power-supply circuit that supplies high-frequency signals to the antenna element 11, and generates or processes the high-frequency signals. The power-supply circuit 30 may also include a circuit that combines or separates the high-frequency signals.

The impedance converting circuit 45 includes a first inductance element L1 connected to the power-supply circuit 30 and a second inductance element L2 coupled to the first inductance element L1. More specifically, a first end and a second end of the first inductance element L1 are connected to the power-supply circuit 30 and ground, respectively, and a first end and a second of the second inductance element L2 are connected to the first antenna element 11 and ground, respectively.

The first inductance element L1 and the second inductance element L2 are transformer coupled, i.e., tightly coupled, to each other so as to generate an equivalent negative inductance. The equivalent negative inductance cancels an effective inductance of the antenna element 11, so that the resulting effective inductance of the antenna element 11 is greatly reduced. That is, since the effective inductance of the antenna element 11 is greatly reduced, the antenna element 11 is less likely to be dependent on the frequency of high-frequency signals received and transmitted via the antenna element 11.

The impedance converting circuit 45 preferably includes a transformer-type circuit in which the first inductance element L1 and the second inductance element L2 are transformer coupled to each other via a mutual inductance M. The transformer-type circuit is equivalently transformed into a T-type circuit including three inductance elements Z1, Z2, and Z3, as shown in FIG. 1B. That is, the T-type circuit includes a first port P1 connected to the power-supply circuit, a second port P2 connected to the antenna element 11, a third port P3 connected to ground, a first inductance element Z1 connected between the first port P1 and a branch point, a second inductance element Z2 connected between the second port P2 and the branch point A, and a third inductance element Z3 connected between the third port P3 and the branch point A.

The inductance of the first inductance element L1 shown in FIG. 1A is indicated by L1, the inductance of the second inductance element L2 is indicated by L2, and the mutual inductance is indicated by M. In this case, the inductance of the first inductance element Z1 in FIG. 1B is L1−M, the inductance of the second inductance element Z2 is L2−M, and the inductance of the third inductance element Z3 is +M. For a relationship L2<M, the inductance of the second inductance element Z2 has a negative value. That is, an equivalent negative composite inductance component is generated in this case.

On the other hand, as shown in FIG. 1B, the antenna element 11 is equivalently constituted by an inductance component LANT, a radiation resistance component Rr, and a capacitance component CANT. The inductance component LANT of the antenna element 11 alone acts so that it is canceled by the negative composite inductance component (L2−M) in the impedance converting circuit 45. That is, the effective inductance (of the antenna element 11 including the second inductance element Z2), when the antenna element 11 side is viewed from the point A in the impedance converting circuit, is reduced (ideally, to zero), and consequently, the impedance frequency characteristic of the antenna device 101 becomes small.

In order to generate a negative inductance component in the manner described above, it is important to cause the first inductance element and the second inductance element to couple to each other with a high degree of coupling. More specifically, the degree of coupling preferably is 1 or greater, for example.

The ratio of the impedance transformation performed by the transformer-type circuit is the ratio of the inductance L2 of the second inductance element L2 to the inductance L1 of the first inductance element L1 (L1:L2).

Figure 2:
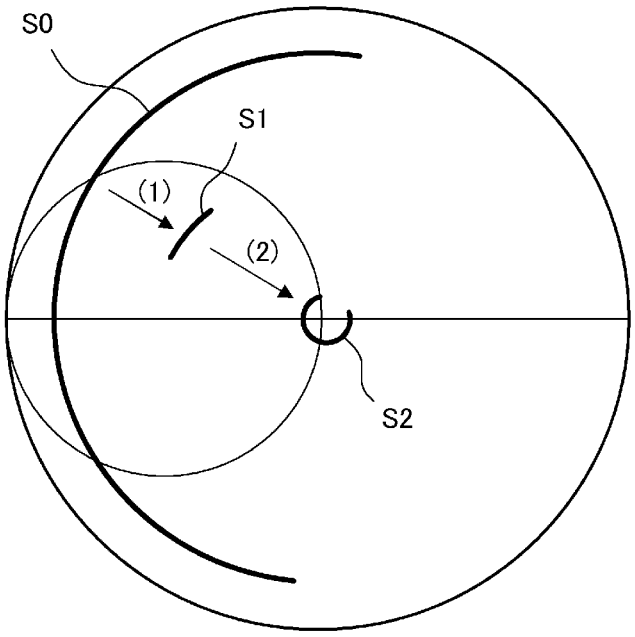
FIG. 2 is a chart showing an effect of an equivalent negative inductance generated in an impedance converting circuit 45 and an effect of the impedance converting circuit 45.

FIG. 2 is a chart schematically showing an effect of the negative inductance component generated in the impedance converting circuit 45 in an equivalent manner and an effect of the impedance converting circuit 45. A curve S0 in FIG. 2 represents, on a Smith chart, an impedance trace obtained by sweeping the frequency over a frequency band used by the antenna element 11. Since the inductance component LANT in the antenna element 11 alone is relatively large, the impedance changes greatly as shown in FIG. 2.

A curve S1 in FIG. 2 represents the trace of an impedance when the antenna element 11 side is viewed from the point A in the impedance converting circuit. As shown, the equivalent negative inductance component in the impedance converting circuit cancels the inductance component LANT of the antenna element, so that the trace of the impedance when the antenna element side is viewed from the point A is reduced significantly.

A curve S2 in FIG. 2 represents the trace of an impedance viewed from the power-supply circuit 30, i.e., an impedance of the antenna device 101. As shown, in accordance with the impedance transformation ratio (L1:L2) for the transformer-type circuit, the impedance of the antenna device 101 approaches 50Ω (the center of the Smith chart). The impedance may be finely adjusted by adding an inductance element and/or a capacitance element to the transformer-type circuit.

In the manner described above, impedance changes in the antenna device can be remarkably suppressed over a wide band. Accordingly, impedance matching with the power-supply circuit is achieved over a wide frequency band.

Second Preferred Embodiment

Figure 3A:
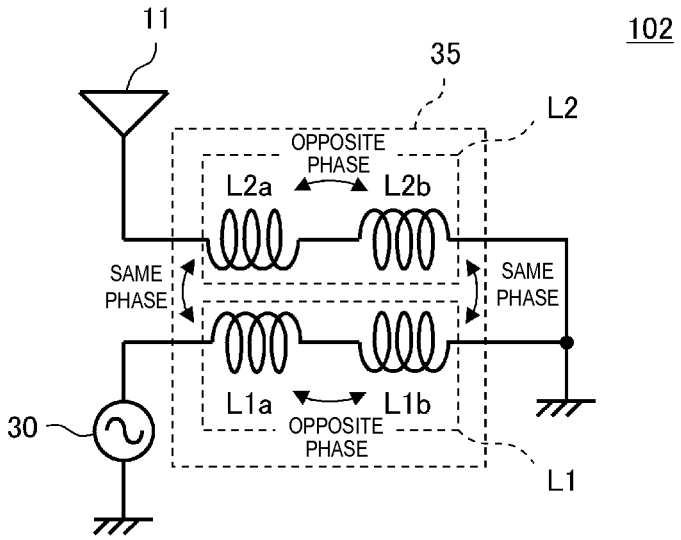
FIG. 3A is a circuit diagram of an antenna device 102 of a second preferred embodiment and FIG. 3B is a diagram showing a specific arrangement of coil elements therein.
Figure 3B:
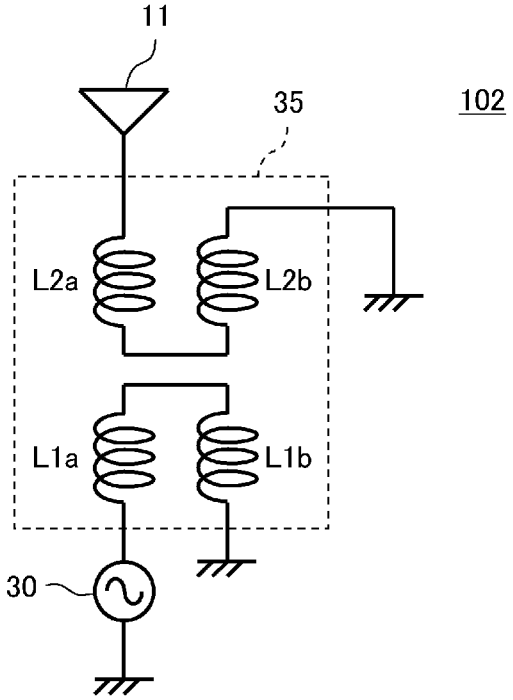

FIG. 3A is a circuit diagram of an antenna device 102 of a second preferred embodiment and FIG. 3B is a diagram showing a specific arrangement of coil elements therein.

Although the basic configuration of the second preferred embodiment preferably is similar to the configuration of the first preferred embodiment, FIGS. 3A and 3B show a more specific configuration to cause a first inductance element and a second inductance element to couple to each other with a significantly high degree of coupling (i.e., to couple tightly as in transformer coupling).

As shown in FIG. 3A, a first inductance element L1 includes a first coil element L1*a* and a second coil element L1*b*, which are interconnected in series and are wound so as to define a closed magnetic path. A second inductance element L2 includes a third coil element L2*a* and a fourth coil element L2*b*, which are interconnected in series and are wound so as to define a closed magnetic path. In other words, the first coil element L1*a* and the second coil element L1*b* couple to each other in an opposite phase (additive polarity coupling) and the third coil element L2*a* and the fourth coil element L2*b* couple to each other in an opposite phase (additive polarity coupling).

In addition, it is preferable that the first coil element L1*a* and the third coil element L2*a* couple to each other in the same phase (subtractive polarity coupling) and the second coil element L1*b* and the fourth coil element L2*b* couple to each other in the same phase (subtractive polarity coupling).

Figure 4:
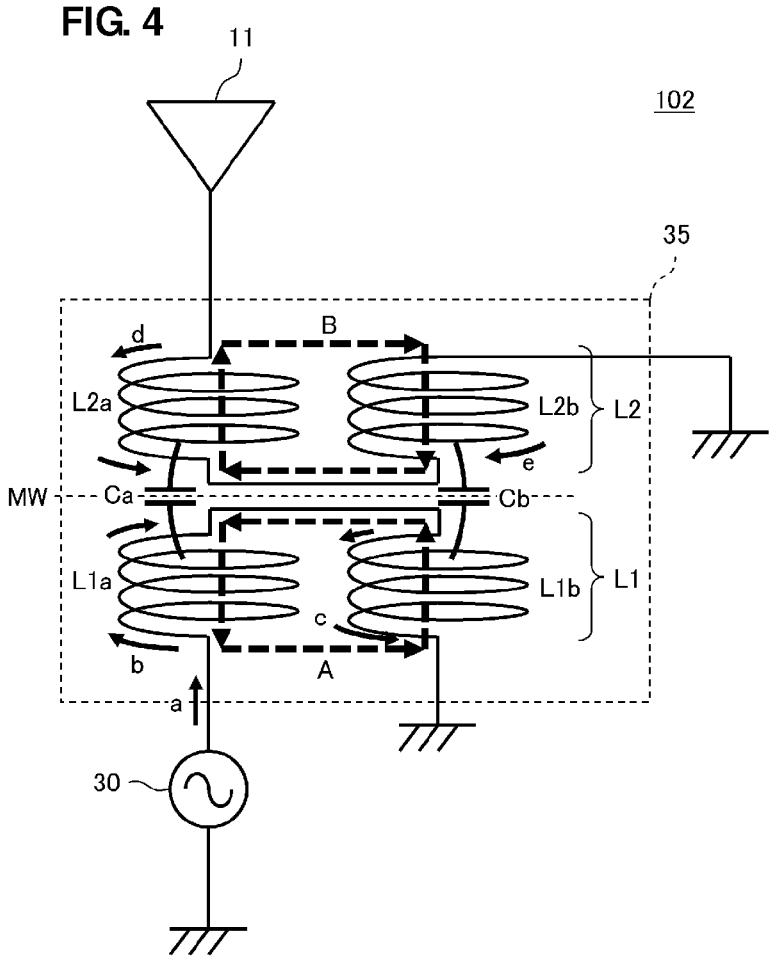
FIG. 4 is a diagram in which various arrows indicating the states of magnetic-field coupling and electric-field coupling are shown in the circuit shown in FIG. 3B.

FIG. 4 is a diagram in which various arrows indicating the states of magnetic-field coupling and electric-field coupling are shown in the circuit of FIG. 3B. As shown in FIG. 4, when a current is supplied from the power-supply circuit in a direction indicated by arrow a in the figure, a current flows in the first coil element L1*a* in a direction indicated by arrow b in the figure and also a current flows in the second coil element L1*b* in a direction indicated by arrow c in the figure. Those currents generate a magnetic flux passing through a closed magnetic path, as indicated by arrow A in the figure.

Since the coil element L1*a* and the coil element L2*a* are parallel to each other, a magnetic field generated as a result of flowing of the current b in the first coil element L1*a* couples to the coil element L2*a* and thus an induced current d flows in the coil element L2*a* in an opposite direction. Similarly, since the coil element L1*b* and the coil element L2*b* are parallel to each other, a magnetic field generated as a result of flowing of the current c in the coil element L1*b* couples to the coil element L2*b* and thus an induced current e flows in the coil element L2*b* in an opposite direction. Those currents generate a magnetic flux passing through a closed magnetic path, as indicated by arrow B in the figure.

Since the closed magnetic path for the magnetic flux A generated in the first inductance element L1 including the coil element L1*a* and L1*b* and the closed magnetic path for the magnetic flux B generated in the second inductance element L2 constituted by the coil elements L1*b* and L2*b* are independent from each other, an equivalent magnetic wall MW is generated between the first inductance element L1 and the second inductance element L2.

The coil element L1*a* and the coil element L2*a* also couple to each other via an electric field. Similarly, the coil element L1*b* and the coil element L2*b* couple to each other via an electric field. Accordingly, when alternating-current signals flow in the coil element L1*a* and the coil element L1*b*, the electric-field couplings cause currents to be excited in the coil element L2*a* and the coil element L2*b*. Capacitors Ca and Cb in FIG. 4 symbolically indicate coupling capacitances for the electric-field couplings.

When an alternating current flows in the first inductance element L1, the direction of a current flowing in the second inductance element L2 as a result of the coupling via the magnetic field and the direction of a current flowing in the second inductance element L2 as a result of the coupling via the electric field are the same. Accordingly, the first inductance element L1 and the second inductance element L2 couple to each other strongly via both the magnetic field and the electric field. That is, it is possible to reduce the amount of loss and it is possible to transmit a high-frequency energy.

The impedance converting circuit 35 can be regarded as a circuit configured such that, when an alternating current flows in the first inductance element L1, the direction of a current flowing in the second inductance element L2 as a result of coupling via a magnetic field and the direction of a current flowing in the second inductance element L2 as a result of coupling via an electric field are the same.

Figure 5:
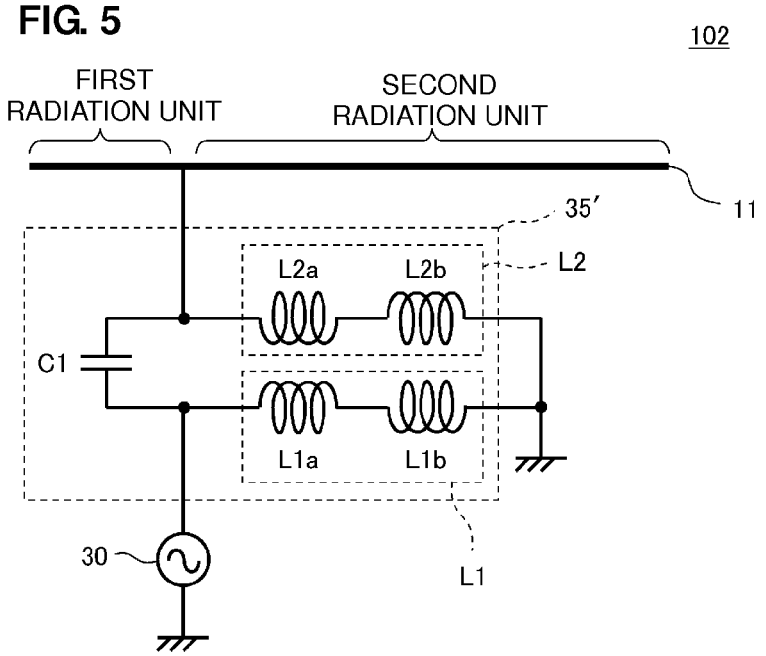
FIG. 5 is a circuit diagram of a multiband-capable antenna device 102.

FIG. 5 is a circuit diagram of a multiband-capable antenna device 102. This antenna device 102 is preferably for use in a multiband-capable mobile wireless communication system (a 800 MHz band, 900 MHz band, 1800 MHz band, and 1900 MHz band) that is compatible with a GSM system or a CDMA system. An antenna element 11 preferably is a branched monopole antenna.

An impedance converting circuit 35' used in this case has a structure in which a capacitor C1 is interposed between a first inductance element L1 constituted by a coil element L1*a* and a coil element L1*b* and a second inductance element L2 constituted by a coil element L2*a* and a coil element L2*b*, and other configurations are similar to those of the above-described impedance converting circuit 35.

This antenna device 102 is preferably utilized as a main antenna for a communication terminal apparatus. A first radiation unit of the branched monopole antenna element 11 acts mainly as an antenna radiation element for a high band side (a band of 1800 to 2400 MHz) and the first radiation unit and a second radiation unit together act mainly as an antenna element for a low band side (a band of 800 to 900 MHz). In this case, the branched monopole antenna element 11 does not necessarily have to resonate at the respective corresponding frequency bands. This is because the impedance converting circuit 35' causes the characteristic impedance of each radiation unit to match the impedance of a power-supply circuit 30. The impedance converting circuit 35' causes the characteristic impedance of the second radiation unit to match the impedance (typically, about 50Ω) of the power-supply circuit 30, for example, in the band of 800 MHz to 900 MHz. As a result, it is possible to cause low-band high-frequency signals supplied from the power-supply circuit 30 to be radiated from the second radiation unit or it is possible to cause low-band high-frequency signals received by the second radiation unit to be supplied to the power-supply circuit 30. Similarly, it is possible to cause a high-band high-frequency signals supplied from the power-supply circuit 30 to be radiated from the first radiation unit or it is possible to cause a high-band high-frequency signals received by the first radiation unit to be supplied to the power-supply circuit 30.

The capacitor C1 in the impedance converting circuit 35' allows passage of particularly high-frequency band signals of high-band high-frequency signals. This can achieve an even wider band of the antenna device. According to the structure of the present preferred embodiment, since the antenna and the power-supply circuit are separated from each other in terms of direct current, the structure is tolerant of ESD.

Third Preferred Embodiment

Figure 6A:
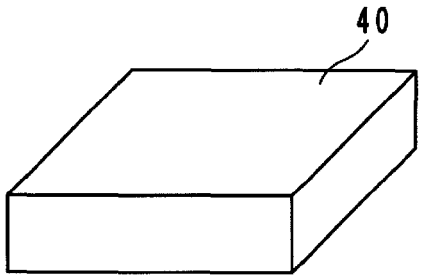
FIG. 6A is a perspective view of an impedance converting circuit 35 of a third preferred embodiment and FIG. 6B is a perspective view when the impedance converting circuit 35 is viewed from the lower-surface side.
Figure 6B:
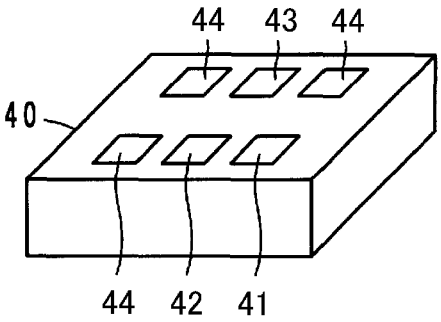
Figure 7:
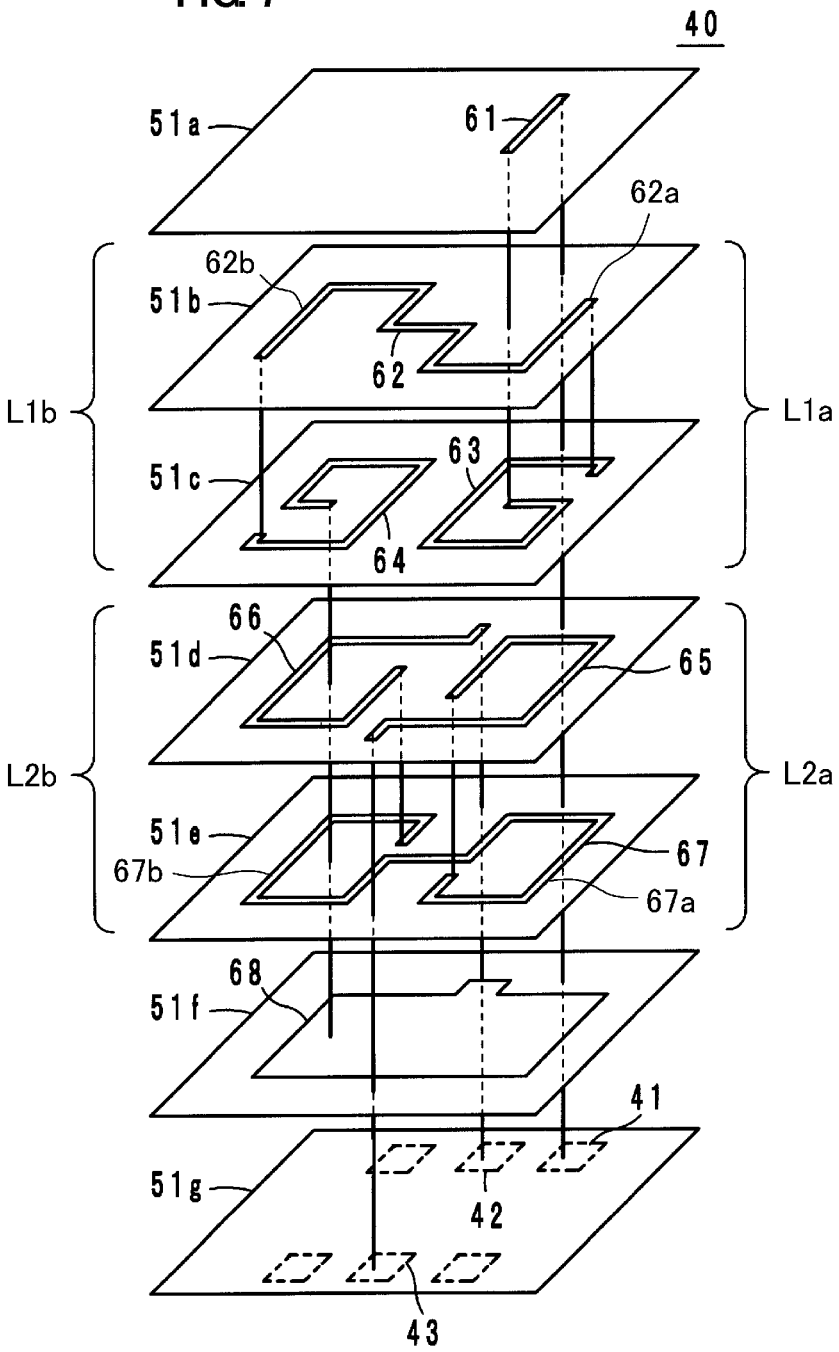
FIG. 7 is an exploded perspective view of a laminate 40 that provides the impedance converting circuit 35.

FIG. 6A is a perspective view of an impedance converting circuit 35 of a third preferred embodiment and FIG. 6B is a perspective view when the impedance converting circuit 35 is viewed from the lower-surface side. FIG. 7 is an exploded perspective view of a laminate 40 that provides the impedance converting circuit 35.

As shown in FIG. 7, a conductor pattern 61 is provided at a base layer 51*a*, which is an uppermost layer of the laminate 40, a conductor pattern 62 (62*a* and 62*b*) is provided at a base layer 51*b*, which is a second layer, and conductor patterns 63 and 64 are provided at a base layer 51*c*, which is a third layer. Two conductor patterns 65 and 66 are provided at a base layer 51*d*, which is a fourth layer, and a conductor pattern 67 (67*a* and 67*b*) is provided at a base layer 51*e*, which is a fifth layer. In addition, a ground conductor 68 is provided at a base layer 51*f*, which is a sixth layer, and a power-supply terminal 41, a ground terminal 42, and an antenna terminal 43 are provided at the reverse side of a base layer 51*g*, which is a seventh layer. A plain base layer, which is not shown, is stacked on the base layer 51*a*, which is the uppermost layer.

The conductor patterns 62*a* and 63 constitute the first coil element L1*a* and the conductor patterns 62*b* and 64 constitute the second coil element L1*b*. The conductor patterns and 67*a* constitute the third coil element L2*a* and the conductor patterns 66 and 67*b* constitute the fourth coil element L2*b*.

The various conductor patterns 61 to 68 can be formed using conductive material, such as silver or copper, as a main component, for example. For the base layers 51*a* to 51*g*, a glass ceramic material, an epoxy resin material, or the like can be used in the case of a dielectric substance and a ferrite ceramic material, a resin material containing ferrite, or the like can be used in the case of a magnetic substance, for example. As a material for the base layers, it is preferable to use, for example, a dielectric material when an impedance converting circuit for a UHF band is to be provided and it is preferable to use a magnetic material when an impedance converting circuit for an HF band is to be provided.

As a result of lamination of the base layers 51*a* to 51*g*, the conductor patterns 61 to 68 and the terminals 41, 42, and 43 are connected through corresponding inter-layer connection conductors (via conductors) to provide the circuit shown in FIG. 4.

As shown in FIG. 7, the first coil element L1*a* and the second coil element L1*b* are adjacently arranged so that the winding axes of the coil patterns thereof are parallel to each other. Similarly, the third coil element L2*a* and the fourth coil element L2*b* are adjacently arranged so that the winding axes of the coil patterns thereof are parallel to each other. In addition, the first coil element L1*a* and the third coil element L2*a* are proximately arranged (in a coaxial relationship) so that the winding axes of the coil patterns thereof are along substantially the same straight line. Similarly, the second coil element L1*b* and the fourth coil element L2*b* are proximately arranged (in a coaxial relationship) so that the winding axes of the coil patterns thereof are along substantially the same straight line. That is, when viewed from the stacking direction of the base layers, the conductor patterns that constitute the coil patterns are arranged so as to overlap each other.

Although each of the coil elements L1*a*, L1*b*, L2*a*, and L2*b* is constituted by a substantially two-turn loop conductor, the number of turns is not limited thereto. Also, the winding axes of the coil patterns of the first coil element L1*a* and the third coil element L2*a* do not necessarily have to be arranged so as to be strictly along the same straight line, and may be wound so that coil openings of the first coil element L1*a* and the third coil element L2*a* overlap each other in plan view. Similarly, the winding axes of the coil patterns of the second coil element L1*b* and the fourth coil element L2*b* do not necessarily have to be arranged so as to be strictly along the same straight line, and may be wound so that coil openings of the second coil element L1*b* and the fourth coil element L2*b* overlap each other in plan view.

As described above, the coil elements L1*a*, L1*b*, L2*a*, and L2*b* are incorporated and integrated into the laminate 40 made of a dielectric substance or magnetic substance, particularly, the areas that serve as coupling portions between the first inductance element L1 constituted by the coil elements L1*a* and L1*b* and the second inductance element L2 constituted by the coil elements L2*a* and L2*b* are provided inside the laminate 40. Thus, the element values of the elements constituting the impedance converting circuit 35 and also the degree of coupling between the first inductance element L1 and the second inductance element L2 become less susceptible to an influence from another electronic element disposed adjacent to the laminate 40. As a result, the frequency characteristics can be further stabilized.

Incidentally, since a printed wiring board (not shown) on which the laminate 40 is disposed is provided with various wiring lines, there is a possibility that those wiring lines and the impedance converting circuit 35 interfere with each other. When the ground conductor 68 is provided at the bottom portion of the laminate 40 so as to cover the openings of the coil patterns formed by the conductor patterns 61 to 67, as in the present preferred embodiment, the magnetic fields generated by the coil patterns become less likely to be affected by magnetic fields from the various wiring lines on the printed wiring board. In other words, the inductance values of the coil elements L1*a*, L1*b*, L2*a*, and L2*b* become less likely to vary.

Figure 8:
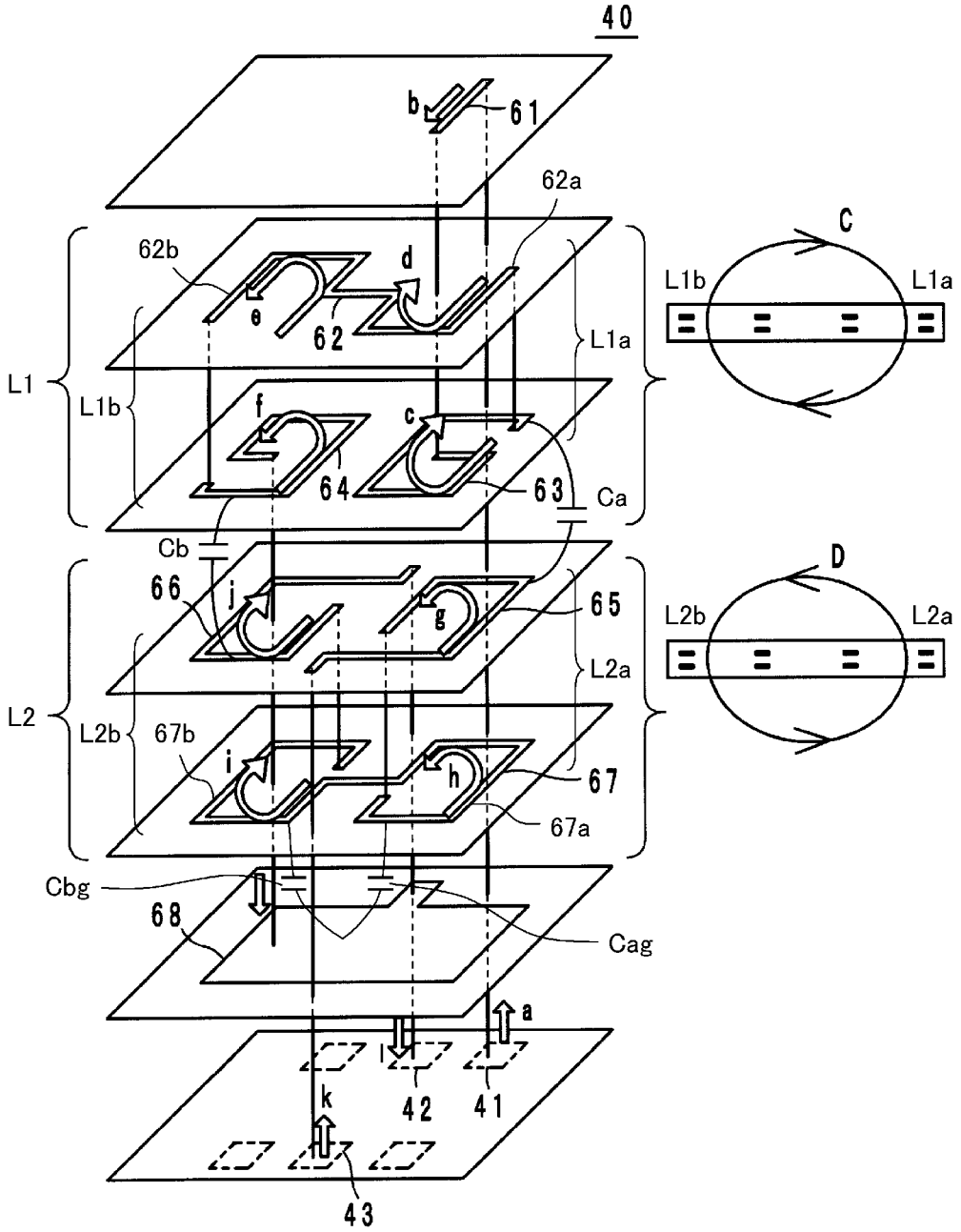
FIG. 8 is a view showing an operation principle of the impedance converting circuit 35.

FIG. 8 is a view showing an operation principle of the impedance converting circuit 35. As shown in FIG. 8, when high-frequency signal currents input from the power-supply terminal flow as indicated by arrows a and b, the currents are introduced into the first coil element L1*a* (the conductor patterns 62*a* and 63), as indicated by arrows c and d, and are further introduced into the second coil element L1*b* (the conductor patterns 62*b* and 64), as indicated by arrows e and f. Since the first coil element L1*a* (the conductor patterns 62*a* and 63) and the third coil element L2*a* (the conductor patterns 65 and 67*a*) are parallel to each other, mutual inductive coupling and electric-field coupling cause high-frequency signal currents indicated by arrows g and h to be induced in the third coil element L2*a* (the conductor patterns 65 and 67*a*).

Similarly, since the second coil element L1*b* (the conductor patterns 62*b* and 64) and the fourth coil element L2*b* (the conductor patterns 66 and 67*b*) are parallel to each other, mutual inductive coupling and electric-field coupling cause high-frequency signal currents indicated by arrows i and j to be induced in the fourth coil element L2*b* (the conductor patterns 66 and 67*b*).

As a result, a high-frequency signal current indicated by arrow k flows through the antenna terminal 43 and a high-frequency signal current indicated by arrow 1 flows through the ground terminal 42. When the current (arrow a) that flows through the power-supply terminal 41 is in an opposite direction, the directions of the other currents are also reversed.

In this case, since the conductor pattern 63 of the first coil element L1*a* and the conductor pattern 65 of the third coil element L2*a* oppose each other, electric-field coupling occurs therebetween and the electric-field coupling causes a current to flow in the same direction as the aforementioned induced current. That is, the magnetic-field coupling and the electric-field coupling increase the degree of coupling. Similarly, magnetic-field coupling and electric-field coupling occur between the conductor pattern 64 of the second coil element L1*b* and the conductor pattern 66 of the fourth coil element L2*b*.

The first coil element L1*a* and the second coil element L1*b* couple to each other in the same phase and the third coil element L2*a* and the fourth coil element L2*b* couple to each other in the same phase to form respective closed magnetic paths. Thus, the two magnetic fluxes C and D are trapped, so that the amount of energy loss between the first coil element L1*a* and the second coil element L1*b* and the amount of energy loss between the third coil element L2*a* and the fourth coil element L2*b* can be reduced. When the inductance values of the first coil element L1*a* and the second coil element L1*b* and the inductance values of the third coil element L2*a* and the fourth coil element L2*b* are set to have substantially the same element value, a leakage magnetic field of the closed magnetic paths is reduced and the energy loss can be further reduced. Naturally, the impedance transformation ratio can be controlled through appropriate design of the element values of the coil elements.

Also, since capacitors Cag and Cbg cause electric-field coupling between the third coil element L2*a* and the fourth coil element L2*b* via the ground conductor 68, currents flowing as a result of the electric-field coupling further increase the degree of coupling between the coil elements L2*a* and L2*b*. If ground is also present at the upper side, the degree of coupling between the first coil element L1*a* and the second coil element L1*b* can also be increased by causing the capacitors Cag and Cbg to generate electric-field coupling between the coil elements L1*a* and L1*b*.

The magnetic flux C excited by a primary current flowing in the first inductance element L1 and the magnetic flux D excited by a secondary current flowing in the second inductance element L2 are generated so that induced currents cause the magnetic fluxes to repel each other. As a result, the magnetic field generated in the first coil element L1*a* and the second coil element L1*b* and the magnetic field generated in the third coil element L2*a* and the fourth coil element L2*b* are trapped in the respective small spaces. Thus, the first coil element L1*a* and the third coil element L2*a* and the second coil element L1*b* and the fourth coil element L2*b* couple to each other at higher degrees of coupling. That is, the first inductance element L1 and the second inductance element L2 couple to each other with a high degree of coupling.

Fourth Preferred Embodiment

Figure 9:
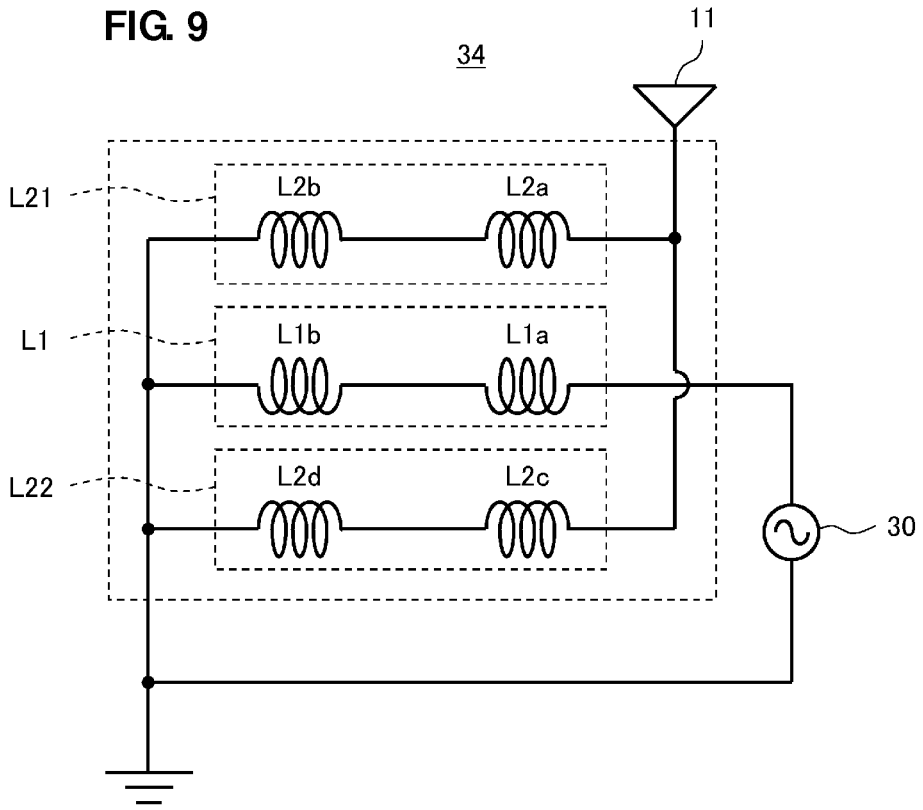
FIG. 9 is a circuit diagram of an antenna device of a fourth preferred embodiment of the present invention.

FIG. 9 is a circuit diagram of an antenna device of a fourth preferred embodiment. An impedance converting circuit 34 used in this case includes a first inductance element L1 and two second inductance elements L21 and L22. The second inductance element L22 is constituted by a fifth coil element L2*c* and a sixth coil element L2*d*, which couple to each other in the same phase. The fifth coil element L2*c* couples to a first coil element L1*a* in an opposite phase and the sixth coil element L2*d* couples to a second coil element L1*b* in an opposite phase. One end of the fifth coil element L2*c* is connected to a radiation element 11 and one end of the sixth coil element L2*d* is connected to ground.

Figure 10:
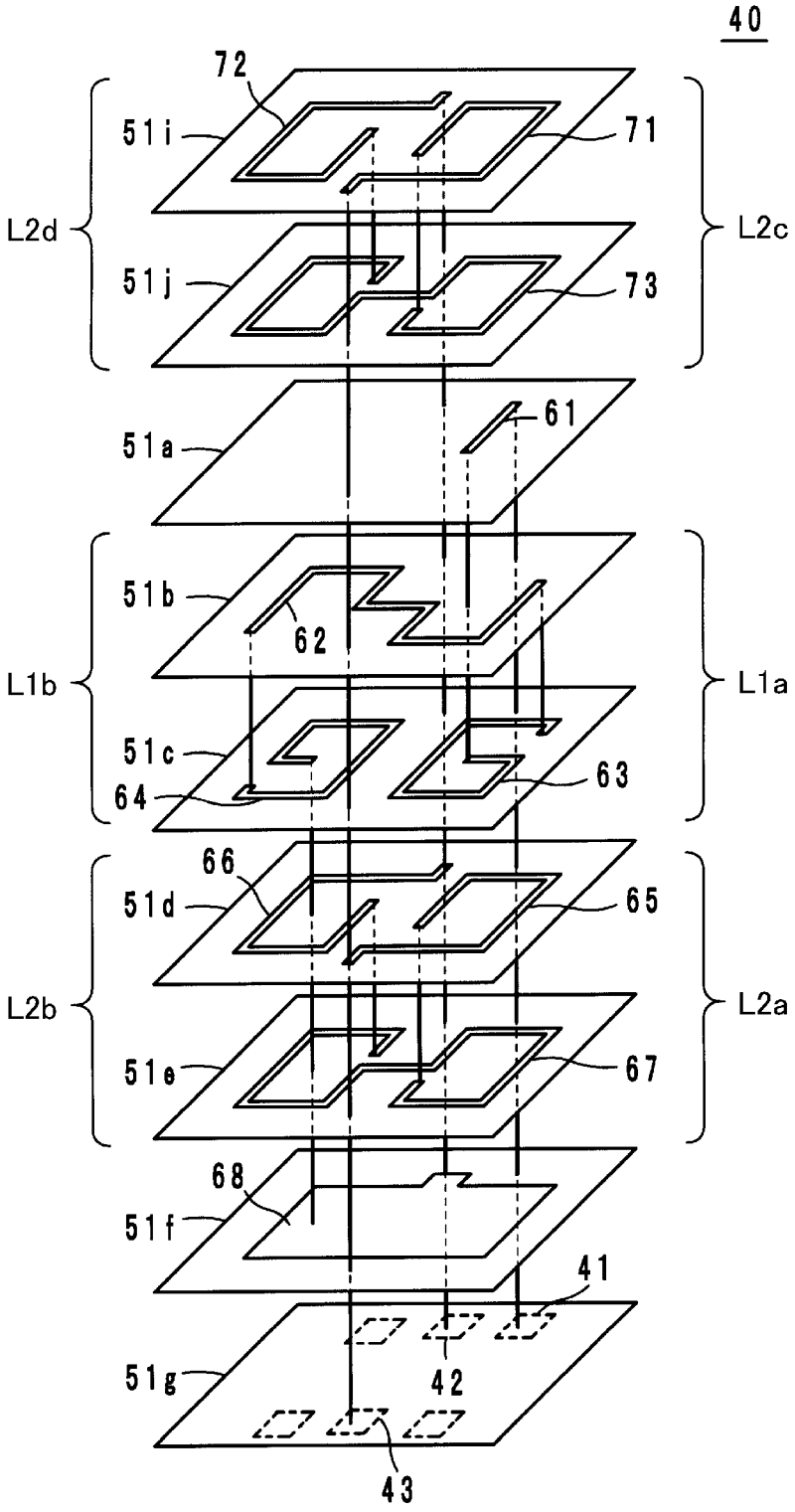
FIG. 10 is an exploded perspective view of a laminate 40 that provides an impedance converting circuit 34.

FIG. 10 is an exploded perspective view of a laminate that provides the impedance converting circuit 34. This example is an example in which base layers 51*i* and 51*j* in which conductors 71, 72, and 73 constituting the fifth coil element L2*c* and the sixth coil element L2*d* are formed are further stacked on the laminate 40 shown in FIG. 7 in the third preferred embodiment. That is, the fifth and sixth coil elements are constituted as in the first to fourth coil elements described above, the fifth and sixth coil elements L2*c* and L2*d* are constituted by conductors having coil patterns, and the fifth and sixth coil elements L2*c* and L2*d* are wound so that magnetic fluxes generated in the fifth and sixth coil elements L2*c* and L2*d* define closed magnetic paths.

The operation principle of the impedance converting circuit 34 of the fourth preferred embodiment is essentially similar to the operation principle of the first to third preferred embodiments described above. In the fourth preferred embodiment, the first inductance element L1 is disposed so that it is sandwiched by two second inductance elements L21 and L22, to thereby suppress stray capacitance generated between the first inductance element L1 and ground. As a result of the suppression of such capacitance component that does not contribute to radiation, the radiation efficiency of the antenna can be enhanced.

The first inductance element L1 and the second inductance elements L21 and L22 are more tightly coupled, that is, the leakage magmatic field is reduced, so that the energy transmission loss of high-frequency signals between the first inductance element L1 and the second inductance elements L21 and L22 is reduced.

Fifth Preferred Embodiment

Figure 11A:
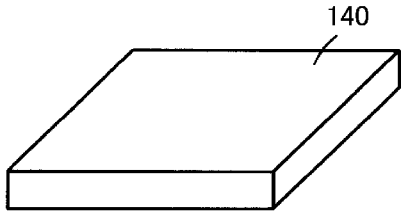
FIG. 11A is a perspective view of an impedance converting circuit 135 of a fifth preferred embodiment and FIG. 11B is a perspective view when the impedance converting circuit 135 is viewed from the lower-surface side.
Figure 11B:
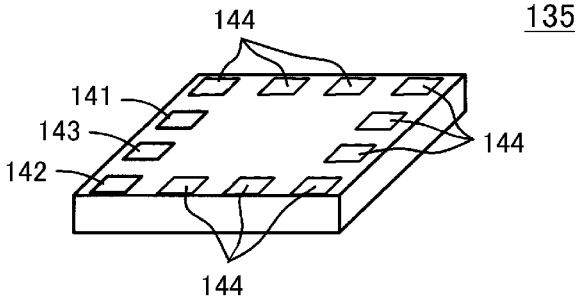
Figure 12:
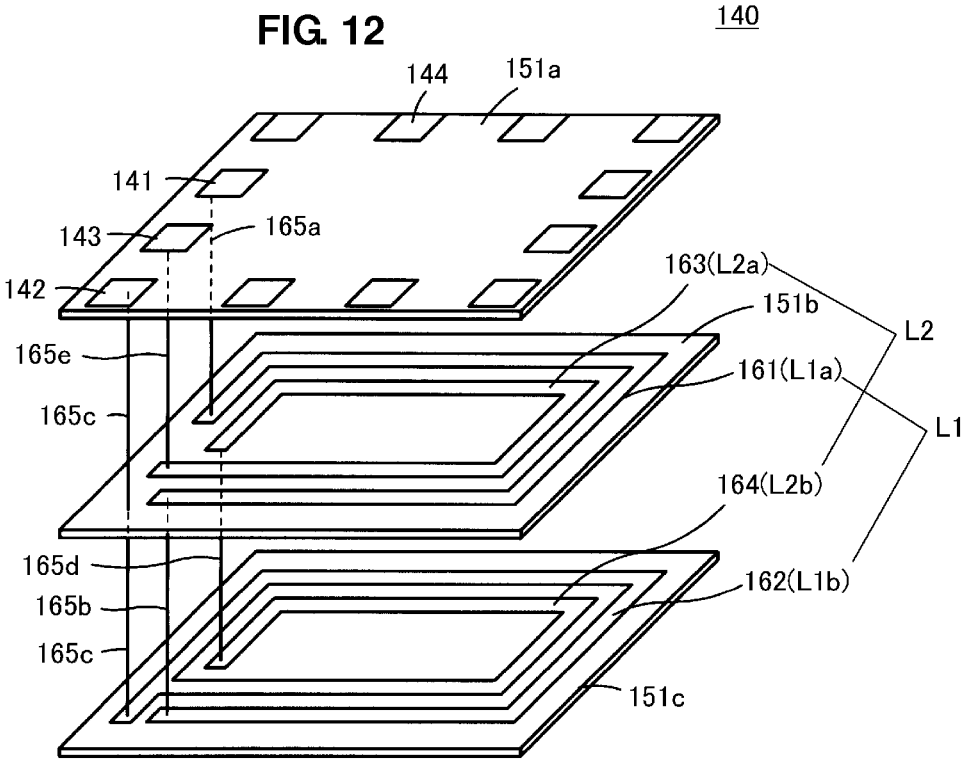
FIG. 12 is an exploded perspective view of a laminate 40 that provides the impedance converting circuit 135.

FIG. 11A is a perspective view of an impedance converting circuit 135 of a fifth preferred embodiment and FIG. 11B is a perspective view when the impedance converting circuit 135 is viewed from the lower-surface side. FIG. 12 is an exploded perspective view of a laminate 40 that provides the impedance converting circuit 135.

This laminate 140 is preferably obtained by laminating multiple base layers made of a dielectric substance or magnetic substance. The reverse side of the laminate 140 is provided with a power-supply terminal 141 connected to a power-supply circuit 30, a ground terminal 142 connected to ground, and an antenna terminal 143 connected to an antenna element 11. In addition, the reverse side of the laminate 140 is also provided with NC terminals 144 used for mounting. The obverse side of the laminate 140 may also be provided with an inductor and/or a capacitor for impedance matching, as needed. An electrode pattern may also be used to define an inductor and/or a capacitor in the laminate 140.

In the impedance converting circuit 135 incorporated into the laminate 140, as shown in FIG. 12, the various terminals 141, 142, 143, and 144 are provided at a base layer 151*a*, which is a first layer, conductor patterns 161 and 163 that serve as first and third coil elements L1*a* and L2*a* are provided at a base layer 151*b*, which is a second layer, and conductor patterns 162 and 164 that serve as second and fourth coil elements L1*b* and L2*b* are provided at a base layer 151*c*, which is a third layer.

The conductor patterns 161 to 164 can be formed preferably by screen printing using a paste containing conductive material, such as silver or copper, as a main component, metallic-foil etching, or the like, for example. For the base layers 151*a* to 151*c*, a glass ceramic material, an epoxy resin material, or the like can be used in the case of a dielectric substance and a ferrite ceramic material, a resin material containing ferrite, or the like can be used in the case of a magnetic substance.

As a result of lamination of the base layers 151*a* to 151*c*, the conductor patterns 161 to 164 and the terminals 141, 142, and 143 are connected to each other through corresponding inter-layer connection conductors (via conductors) to provide the equivalent circuit described above and shown in FIG. 3A. That is, the power-supply terminal 141 is connected to one end of the conductor pattern 161 (the first coil element L1*a*) through a via-hole conductor pattern 165*a* and another end of the conductor pattern 161 is connected to one end of the conductor pattern 162 (the second coil element L1*b*) through a via-hole conductor 165*b*. Another end of the conductor pattern 162 is connected to the ground terminal 142 through a via-hole conductor 165*c* and another end of the branched conductor pattern 164 (the fourth coil element L2*b*) is connected to one end of the conductor pattern 163 (the third coil element L2*a*) through a via-hole conductor 165*d*. Another end of the conductor pattern 163 is connected to the antenna terminal 143 through a via-hole conductor pattern 165*e*.

The coil elements L1*a*, L1*b*, L2*a*, and L2*b* are incorporated into the laminate 140 made of a dielectric substance or magnetic substance, particularly, the areas that serve as coupling portions between the first inductance element L1 and the second inductance element L2 are provided inside the laminate 140, as described above, so that the impedance converting circuit 135 becomes less susceptible to an influence from another circuit or element disposed adjacent to the laminate 140. As a result, the frequency characteristics can be further stabilized.

The first coil element L1*a* and the third coil element L2*a* are provided at the same layer (the base layer 151*b*) in the laminate 140 and the second coil element L1*b* and the fourth coil element L2*b* are provided at the same layer (the base layer 151*c*) in the laminate 140, so that the thickness of the laminate 140 (the impedance converting circuit 135) is reduced. In addition, the first coil element L1*a* and the third coil element L2*a*, which couple to each other, and the second coil element L1*b* and the fourth coil element L2*b*, which couple to each other, can be formed in the corresponding same processes (e.g., conductive-paste application), so that degree-of-coupling variations due to stack displacement or the like are prevented and the reliability improves.

Sixth Preferred Embodiment

Figure 13A:
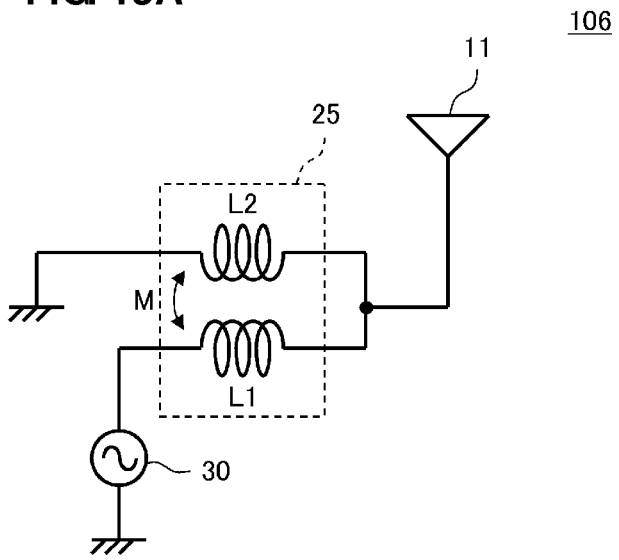
FIG. 13A is a circuit diagram of an antenna device 106 of a sixth preferred embodiment and FIG. 13B is an equivalent circuit diagram thereof.
Figure 13B:
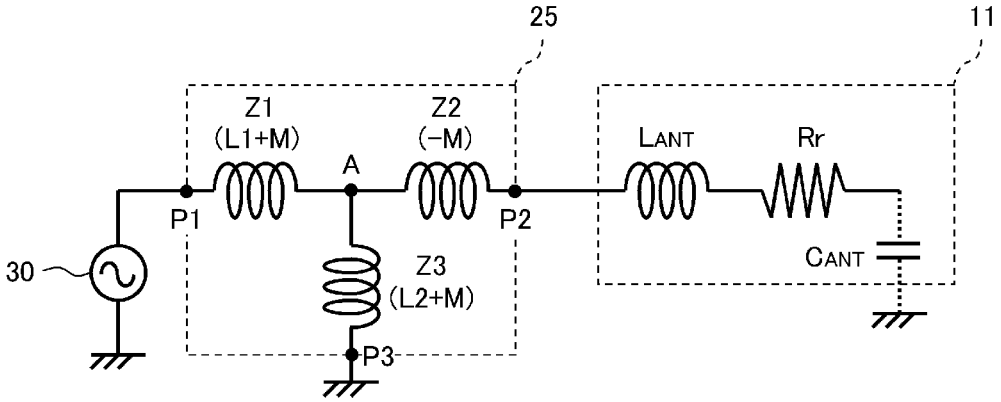

FIG. 13A is a circuit diagram of an antenna device 106 of a sixth preferred embodiment and FIG. 13B is an equivalent circuit diagram thereof.

As shown in FIG. 13A, the antenna device 106 includes an antenna element 11 and an impedance converting circuit 25 connected to the antenna element 11. The antenna element 11 preferably is a monopole antenna, for example. The impedance converting circuit 25 is connected to a power-supply end of the antenna element 11. The impedance converting circuit 25 (strictly speaking, a first inductance element L1 in the impedance converting circuit 25) is interposed between the antenna element 11 and the power-supply circuit 30. The power-supply circuit 30 is a power-supply circuit to supply high-frequency signals to the antenna element 11 and generate or process the high-frequency signals. The power-supply circuit 30 may also include a circuit that combines or separates the high-frequency signals.

The impedance converting circuit 25 includes the first inductance element L1 connected to the power-supply circuit 30 and a second inductance element L2 coupled to the first inductance element L1. More specifically, a first end and a second end of the first inductance element L1 are connected to the power-supply circuit 30 and an antenna, respectively, and a first end and a second end of the second inductance element L2 are connected to the antenna element 11 and ground, respectively.

The first inductance element L1 and the second inductance element L2 are transformer coupled (i.e., tightly coupled) to each other. Thus, a negative inductance component is generated in an equivalent manner. The negative inductance component cancels the inductance component of the antenna element 11, so that the resulting inductance component of the antenna element 11 is reduced. That is, since the effective inductive reactance component of the antenna element 11 is reduced, the antenna element 11 is less likely to be dependent on the frequency of the high-frequency signals.

The impedance converting circuit 25 preferably includes a transformer-type circuit in which the first inductance element L1 and the second inductance element L2 are tightly coupled to each other via a mutual inductance M. The transformer-type circuit is equivalently transformed into a T-type circuit including three inductance elements Z1, Z2, and Z3, as shown in FIG. 13B. That is, this T-type circuit includes a first port P1 connected to the power-supply circuit, a second port P2 connected to the antenna element 11, a third port P3 connected to ground, a first inductance element Z1 connected between the first port P1 and a branch point A, a second inductance element Z2 connected between the second port P2 and the branch point A, and a third inductance element Z3 connected between the third port P3 and the branch point A.

The inductance of the first inductance element L1 shown in FIG. 13A is indicated by L1, the inductance of the second inductance element L2 is indicated by L2, and the mutual inductance is indicated by M. In this case, the inductance of the first inductance element Z1 in FIG. 13B is L1+M, the inductance of the second inductance element Z2 is −M, and the inductance of the third inductance element Z3 is L2+M. That is, the inductance of the second inductance element Z2 has a negative value, regardless of the values of L1 and L2. That is, an equivalent negative inductance component is generated in this case.

On the other hand, as shown in FIG. 13B, the antenna element 11 is equivalently constituted by an inductance component LANT, a radiation resistance component Rr, and a capacitance component CANT. The inductance component LANT of the antenna element 11 alone acts so that it is canceled by the negative inductance component (−M) in the impedance converting circuit 45. That is, the inductance component (of the antenna element 11 including the second inductance element Z2), when the antenna element 11 side is viewed from the point A in the impedance converting circuit is reduced (ideally, to zero), and consequently, the impedance frequency characteristic of the antenna device 106 becomes small.

In order to generate a negative inductance component in the manner described above, it is important to cause the first inductance element and the second inductance element to couple to each other with a high degree of coupling. Specifically, it is preferable that the degree of coupling be about 0.5 or more or, further, about 0.7 or more, though depending on the element values of the inductance elements. That is, with such a configuration, a significantly high degree of coupling, such as the degree of coupling in the first preferred embodiment, is not necessarily required.

Seventh Preferred Embodiment

Figure 14A:
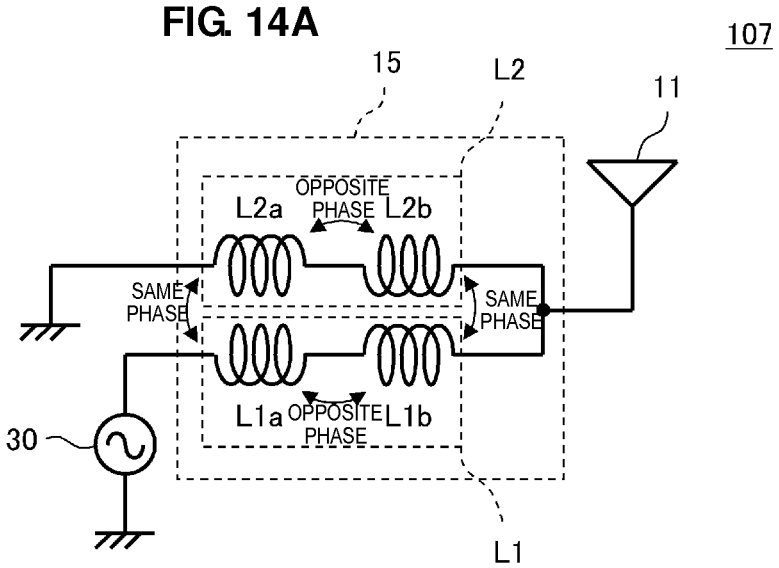
FIG. 14A is a circuit diagram of an antenna device 107 of a seventh preferred embodiment and FIG. 14B is a diagram showing a specific arrangement of coil elements therein.
Figure 14B:
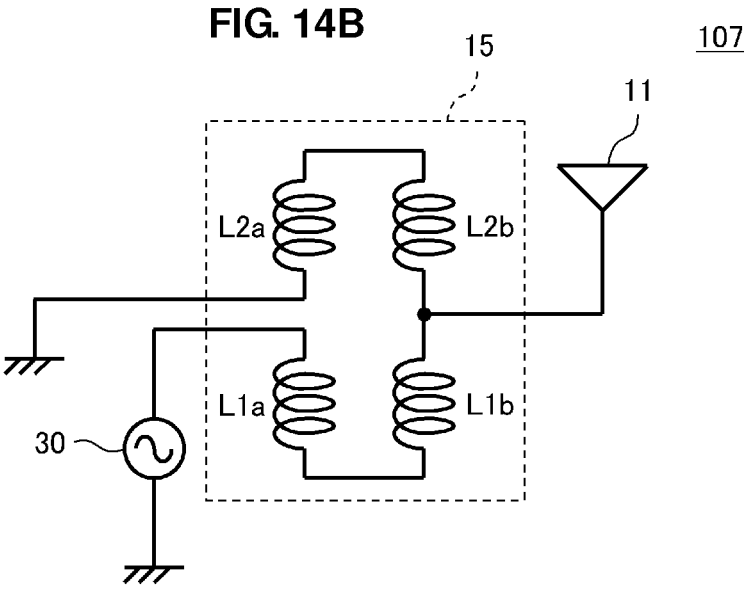

FIG. 14A is a circuit diagram of an antenna device 107 of a seventh preferred embodiment and FIG. 14B is a diagram showing a specific arrangement of coil elements therein.

Although the basic configuration of the seventh preferred embodiment is similar to the configuration of the sixth preferred embodiment, FIGS. 14A and 14B show a more specific configuration to cause the first inductance element and the second inductance element to couple to each other at a significantly high degree of coupling (to couple tightly).

As shown in FIG. 14A, the first inductance element L1 includes a first coil element L1*a* and a second coil element L1*b*, which are interconnected in series and are wound so as to define a closed magnetic path. The second inductance element L2 also includes a third coil element L2*a* and a fourth coil element L2*b*, which are interconnected in series and are wound so as to define a closed magnetic path. In other words, the first coil element L1*a* and the second coil element L1*b* couple to each other in an opposite phase (additive polarity coupling) and the third coil element L2*a* and the fourth coil element L2*b* couple to each other in an opposite phase (additive polarity coupling).

In addition, it is preferable that the first coil element L1*a* and the third coil element L2*a* couple to each other in the same phase (subtractive polarity coupling) and the second coil element L1*b* and the fourth coil element L2*b* couple to each other in the same phase (subtractive polarity coupling).

Figure 15A:
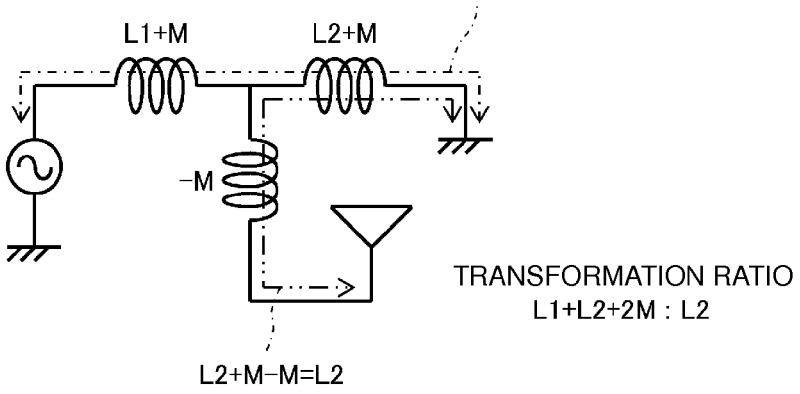
FIG. 15A is a diagram showing the transformation ratio of an impedance converting circuit, the diagram being based on the equivalent circuit shown in FIG. 14B.
Figure 15B:
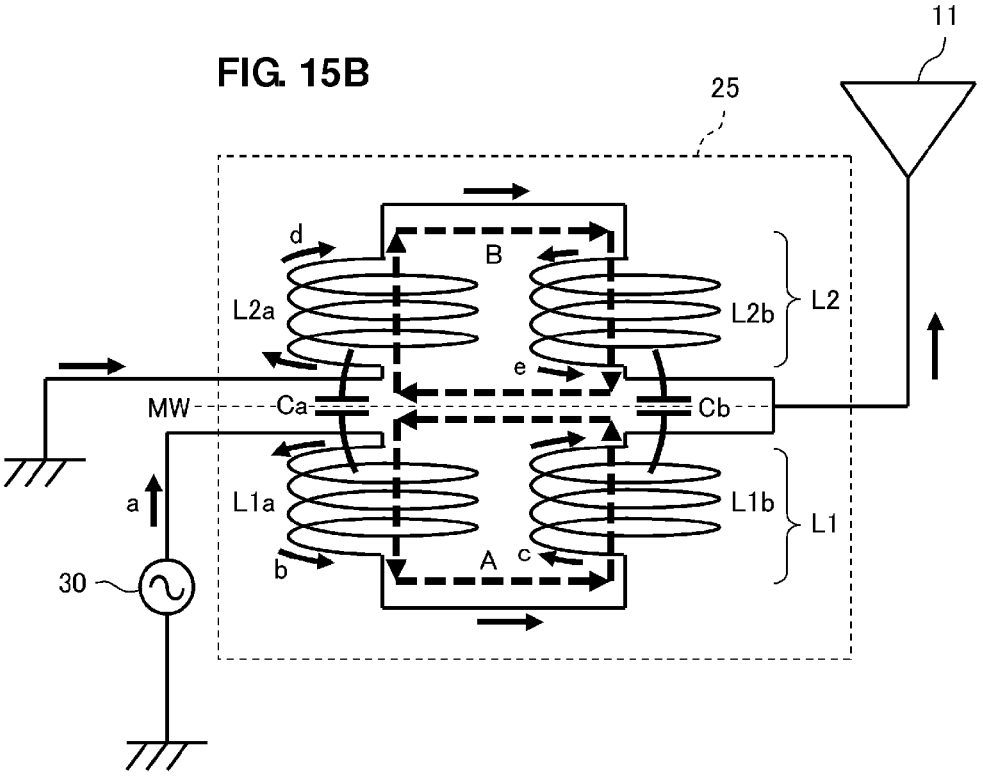
FIG. 15B is a diagram in which various arrows indicating the states of magnetic-field coupling and electric-field coupling are shown in the circuit of FIG. 14B.

FIG. 15A is a diagram showing the transformation ratio of an impedance converting circuit, the diagram being based on the equivalent circuit shown in FIG. 14B. FIG. 15B is a diagram in which various arrows indicating the states of magnetic-field coupling and electric-field coupling are written in the circuit shown in FIG. 14B.

As shown in FIG. 15B, when a current is supplied from the power-supply circuit in a direction indicated by arrow a in the figure, a current flows in the first coil element L1*a* in a direction indicated by arrow b in the figure and also a current flows in the coil element L1*b* in a direction indicated by arrow c in the figure. Those currents define a magnetic flux (passing through a closed magnetic path) indicated by arrow A in the figure.

Since the coil element L1*a* and the coil element L2*a* are parallel to each other, a magnetic field generated as a result of flowing of the current b in the coil element L1*a* couples to the coil element L2*a* and thus an induced current d flows in the coil element L2*a* in an opposite direction. Similarly, since the coil element L1*b* and the coil element L2*b* are parallel to each other, a magnetic field generated as a result of flowing of the current c in the coil element L1*b* couples to the coil element L2*b* and thus an induced current e flows in the coil element L2*b* in an opposite direction. Those currents define a magnetic flux passing through a closed magnetic path, as indicated by arrow B in the figure.

Since the closed magnetic path for the magnetic flux A generated in the first inductance element L1 constituted by the coil element L1*a* and L1*b* and the closed magnetic path for the magnetic flux B generated in the second inductance element L2 constituted by the coil elements L1*b* and L2*b* are independent from each other, an equivalent magnetic wall MW is generated between the first inductance element L1 and the second inductance element L2.

The coil element L1*a* and the coil element L2*a* also couple to each other via an electric field. Similarly, the coil element L1*b* and the coil element L2*b* also couple to each other via an electric field. Accordingly, when alternating-current signals flow in the coil element L1*a* and the coil element L1*b*, the electric-field couplings cause currents to be excited in the coil element L2*a* and the coil element L2*b*. Capacitors Ca and Cb in FIG. 4 symbolically indicate coupling capacitances for the electric-field couplings.

When an alternating current flows in the first inductance element L1, the direction of a current flowing in the second inductance element L2 as a result of the coupling via the magnetic field and the direction of a current flowing in the second inductance element L2 as a result of the coupling via the electric field are the same. Accordingly, the first inductance element L1 and the second inductance element L2 strongly couple to each other via both the magnetic field and the electric field.

The impedance converting circuit 25 can be regarded as a circuit configured such that, when an alternating current flows in the first inductance element L1, the direction of a current flowing in the second inductance element L2 as a result of coupling via a magnetic field and the direction of a current flowing in the second inductance element L2 as a result of coupling via an electric field are the same.

Through equivalent transformation, the impedance converting circuit 25 can be expressed as the circuit in FIG. 15A. That is, the composite inductance component between the power-supply circuit and ground is given by L1+M+L2+M=L1+L2+2M, as indicated by a dashed-dotted line in the figure and the composite inductance component between the antenna element and ground is given by L2+M−M=L2, as indicated by a long dashed double-short dashed line in the figure. That is, the transformation ratio of this impedance converting circuit is L1+L2+2M:L2, thus making it possible to configure an impedance converting circuit having a large transformation ratio.

Figure 16:
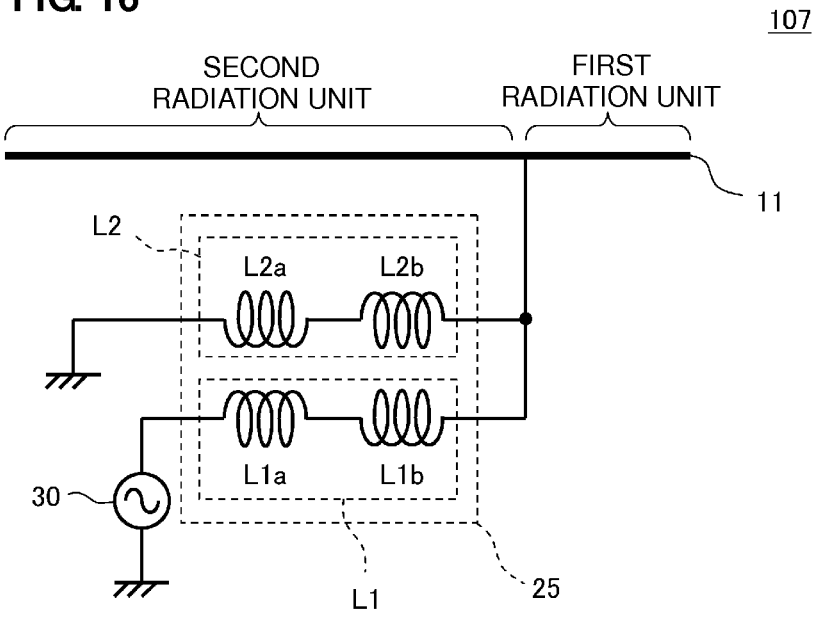
FIG. 16 is a circuit diagram of a multiband-capable antenna device 107.

FIG. 16 is a circuit diagram of a multiband-capable antenna device 107. This antenna device 107 is preferably for use in a multiband-capable mobile wireless communication system (a 800 MHz band, 900 MHz band, 1800 MHz band, and 1900 MHz band) that is compatible with a GSM system or a CDMA system. An antenna element 11 preferably is a branched monopole antenna, for example.

This antenna device 102 is preferably utilized as a main antenna for a communication terminal apparatus. A first radiation unit of the branched monopole antenna element 11 acts mainly as an antenna radiation element for a high band side (a band of 1800 MHz to 2400 MHz) and the first radiation unit and a second radiation unit together act mainly as an antenna element for a low band side (a band of 800 MHz to 900 MHz). In this case, the branched monopole antenna element 11 does not necessarily have to resonate at the individual corresponding frequency bands. This is because an impedance converting circuit 25 causes the characteristic impedance of each radiation unit to match the impedance of a power-supply circuit 30. The impedance converting circuit 25 causes the characteristic impedance of the second radiation unit to match the impedance (typically, 50Ω) of the power-supply circuit 30, for example, in the band of 800 MHz to 900 MHz. As a result, it is possible to cause low-band high-frequency signals supplied from the power-supply circuit 30 to be radiated from the second radiation unit or it is possible to cause low-band high-frequency signals received by the second radiation unit to be supplied to the power-supply circuit 30. Similarly, it is possible to cause high-band high-frequency signals supplied from the power-supply circuit 30 to be radiated from the first radiation unit or it is possible to cause high-band high-frequency signals received by the first radiation unit to be supplied to the power-supply circuit 30.

Eighth Preferred Embodiment

Figure 17:
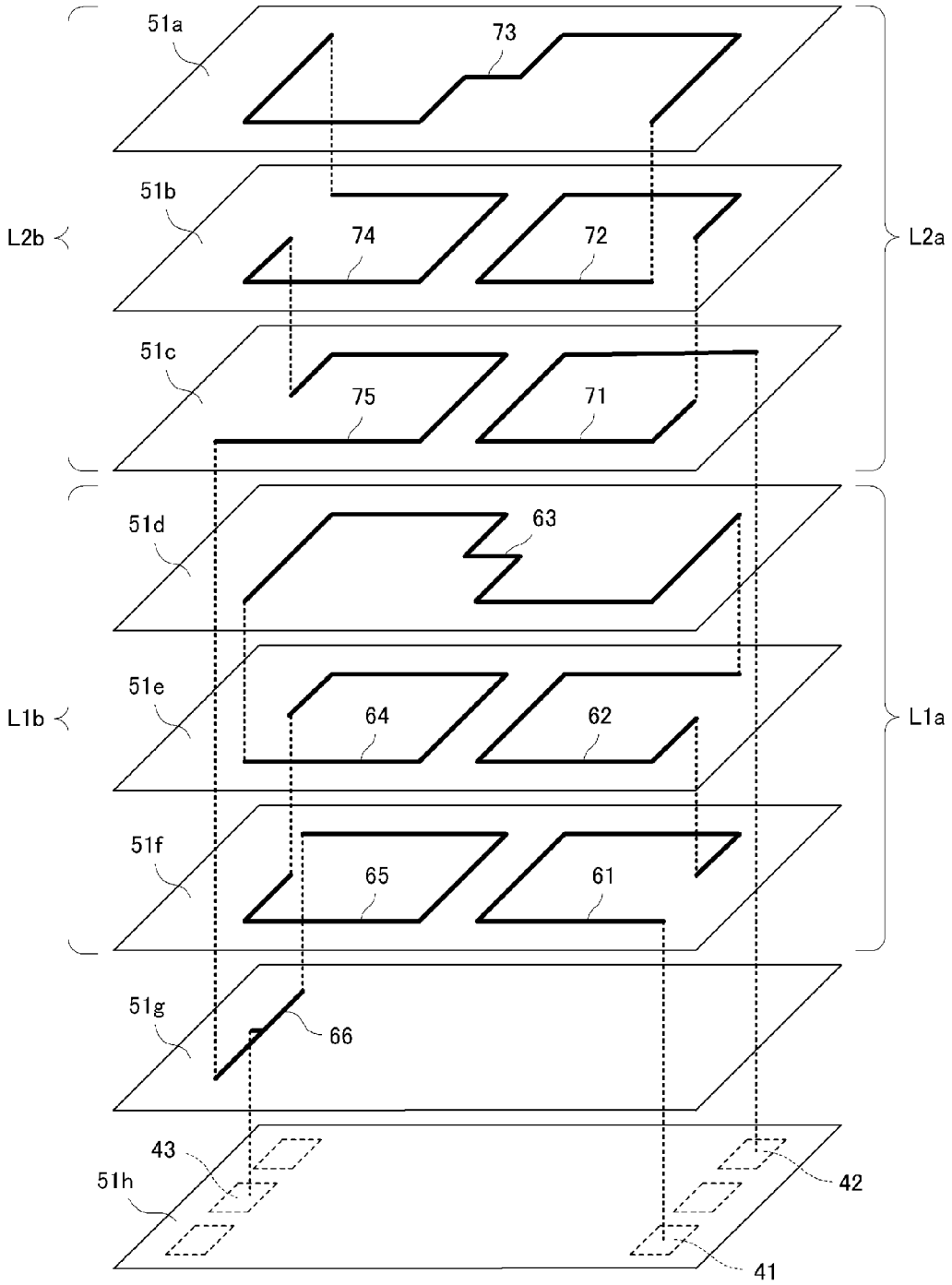
FIG. 17 is a view showing an example of conductor patterns of individual layers when an impedance converting circuit 25 according to an eighth preferred embodiment is configured in a multilayer substrate.

FIG. 17 is a view showing an example of conductor patterns of individual layers when an impedance converting circuit 25 according to an eighth preferred embodiment is configured in a multilayer substrate. The layers are preferably constituted by magnetic sheets. Although the conductor pattern of each layer, when in the direction shown in FIG. 17, is provided at the reverse side of the magnetic sheet, each conductor pattern is indicated by a solid line. Although each linear conductor pattern has a predetermined line width, it is indicated by a simple solid line in this case.

A conductor pattern 73 is provided in the area indicated in FIG. 17 and at the reverse side of a base layer 51*a*, conductor patterns 72 and 74 are provided at the reverse side of a base layer 51*b*, and conductor patterns 71 and 75 are provided at the reverse side of a base layer 51*c*. A conductor pattern 63 is provided at the reverse side of a base layer 51*d*, conductor patterns 62 and 64 are provided at the reverse side of a base layer 51*e*, and conductor patterns 61 and 65 are provided at the reverse side of a base layer 51*f*. A conductor pattern 66 is provided at the reverse side of a base layer 51*g*, and a power-supply terminal 41, a ground terminal 42, and an antenna terminal 43 are provided at the reverse side of a base layer 51*h*. Dotted lines extending vertically in FIG. 17 represent via electrodes, which provide inter-layer connections between the corresponding conductor patterns. Although these via electrodes are, in practice, cylindrical electrodes having predetermined diameter dimensions, they are indicated by simple dotted lines in this case.

In FIG. 17, the right half of the conductor pattern 63 and the conductor patterns 61 and 62 constitute a first coil element L1*a*. Also, the left half of the conductor pattern 63 and the conductor patterns 64 and 65 constitute a second coil element L1*b*. Also, the right half of the conductor pattern 73 and the conductor patterns 71 and 72 constitute a third coil element L2*a*. Also, the left half of the conductor pattern 73 and the conductor patterns 74 and 75 constitute a fourth coil element L2*b*. The winding axes of the coil elements L1*a*, L1*b*, L2*a*, and L2*b* are oriented in the stacking direction of the multiplayer substrate. The winding axes of the first coil element L1*a* and the second coil element L1*b* are juxtaposed to have a different relationship. Similarly, the third coil element L2*a* and the fourth coil element L2*b* are juxtaposed so that the winding axes thereof have a different relationship. The winding area of the first coil element L1*a* and the winding area of the third coil element L2*a* overlap each other at least partially in plan view and the winding area of the second coil element L1*b* and the winding area of the fourth coil element L2*b* overlap each other at least partially in plan view. In this example, they overlap each other substantially completely. In the manner described above, four coil elements are configured with conductor patterns having an 8-shaped structure.

Each layer may also be configured with a dielectric sheet. However, the use of a magnetic sheet having a high relative permeability makes it possible to further increase the coefficient of coupling between the coil elements.

Figure 18:
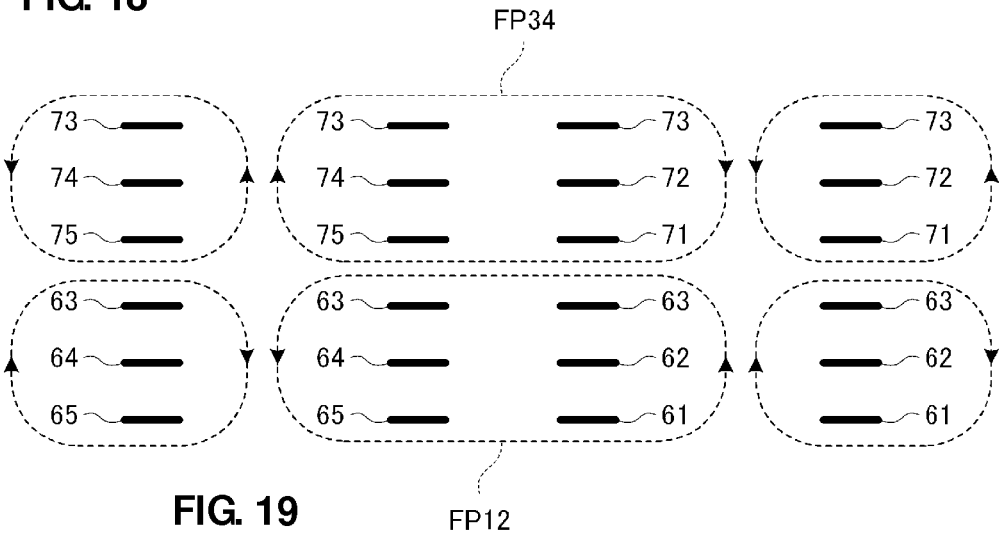
FIG. 18 shows major magnetic fluxes that pass through the coil elements having the conductor patterns provided at the layers of the multiplayer substrate shown in FIG. 17.

FIG. 18 shows major magnetic fluxes that pass through the coil elements having the conductor patterns provided at the layers of the multiplayer substrate shown in FIG. 17. A magnetic flux FP12 passes through the first coil element L1*a* constituted by the conductor patterns 61 to 63 and the second coil element L1*b* constituted by the conductor patterns 63 to 65. A magnetic flux FP34 passes through the third coil element L2*a* constituted by the conductor patterns 71 to 73 and the fourth coil element L2*b* constituted by the conductor patterns 73 to 75.

Figure 19:
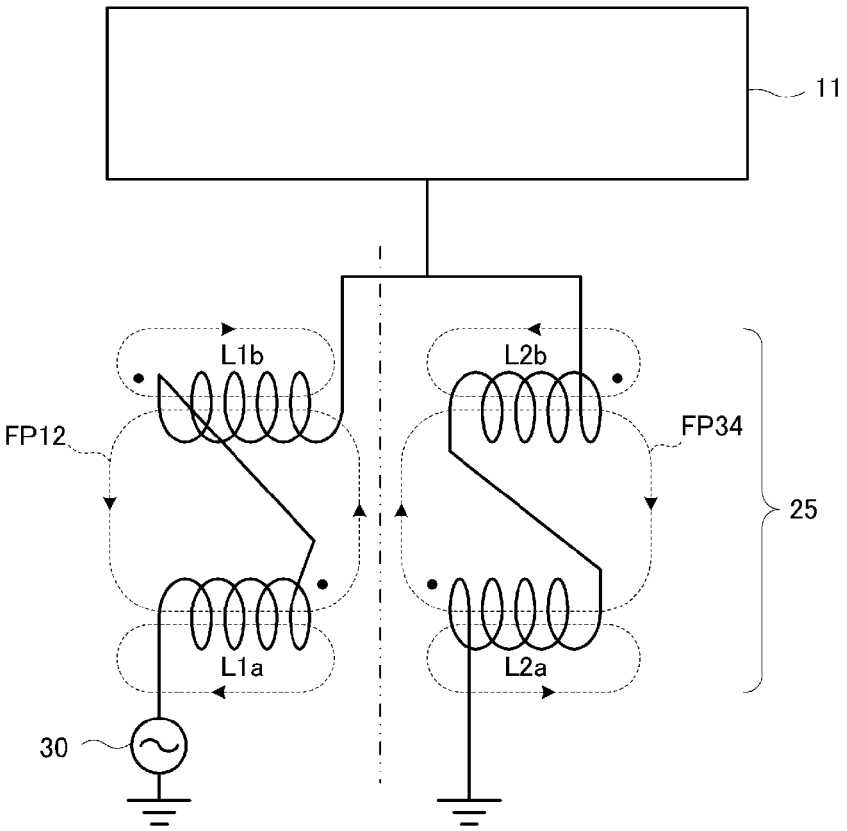
FIG. 19 is a diagram showing a relationship of magnetic couplings of four coil elements L1*a*, L1*b*, L2*a*, and L2*b* in the impedance converting circuit 25 according to the eighth preferred embodiment of the present invention.

FIG. 19 is a diagram showing a relationship of magnetic couplings of four coil elements L1*a*, L1*b*, L2*a*, and L2*b* in the impedance converting circuit 25 according to the eighth preferred embodiment. As shown, the first coil element L1*a* and the second coil element L1*b* are wound so that the first coil element L1*a* and the second coil element L1*b* constitute a first closed magnetic path (a loop represented by the magnetic flux FP12) and the third coil element L2*a* and the fourth coil element L2*b* are wound so that the third coil element L2*a* and the fourth coil element L2*b* constitute a second closed magnetic path (a loop represented by the magnetic flux FP34). Thus, the four coil elements L1*a*, L1*b*, L2*a*, and L2*b* are wound so that the magnetic flux FP12 passing through the first closed magnetic path and the magnetic flux FP34 passing through the second closed magnetic path are in directions opposite to each other. A straight line indicated by a long dashed double-short dashed line in FIG. 19 represents a magnetic wall at which the two magnetic fluxes FP12 and FP34 do not couple to each other. In this manner, the magnetic wall is generated between the coil elements L1*a* and L2*a* and between the coil elements L1*b* and L2*b*.

Ninth Preferred Embodiment

Figure 20:
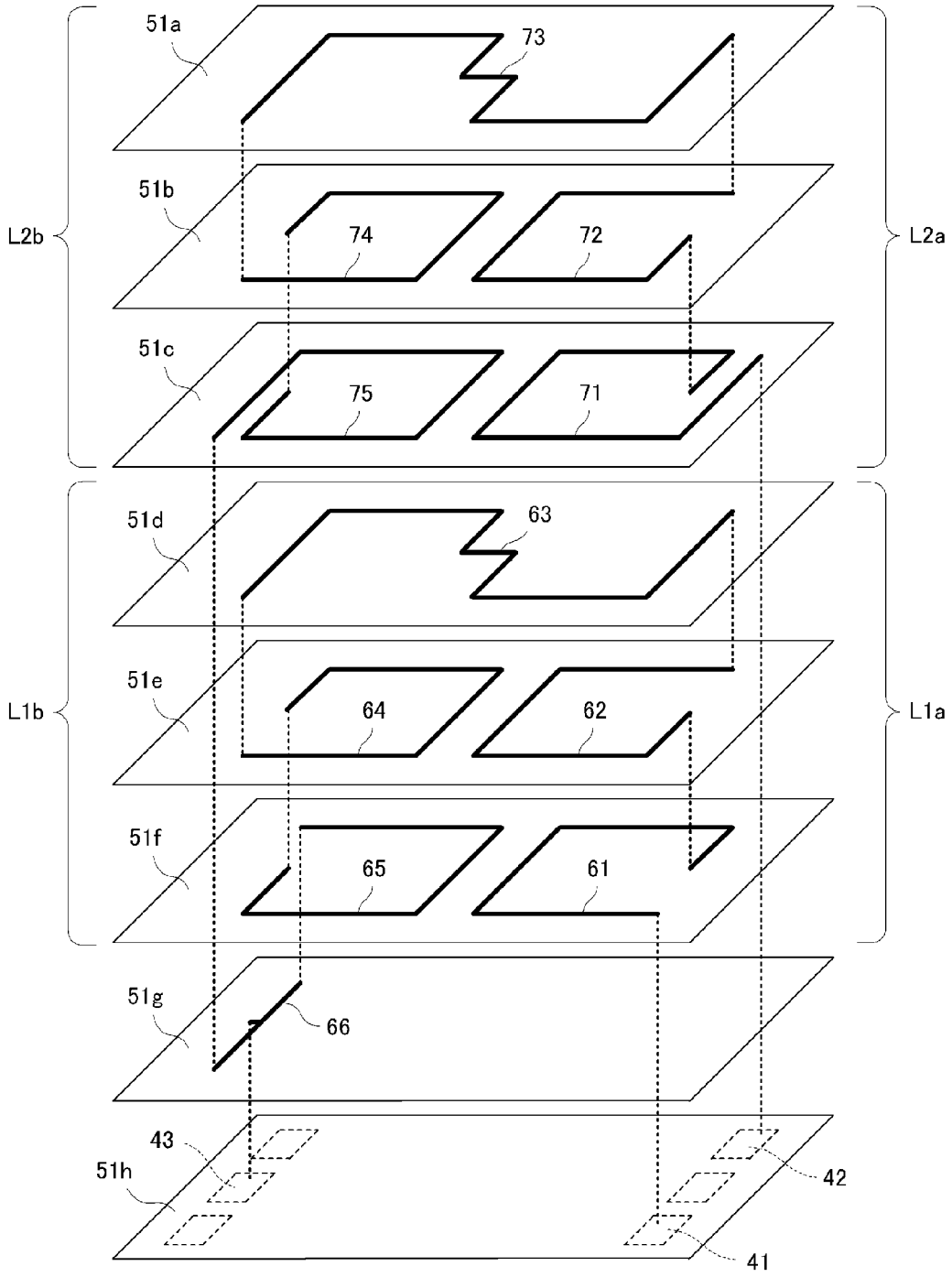
FIG. 20 is a view showing the configuration of an impedance converting circuit according to a ninth preferred embodiment and showing an example of conductor patterns of individual layers when the impedance converting circuit is configured in a multilayer substrate.

FIG. 20 is a view showing the configuration of an impedance converting circuit according to a ninth preferred embodiment and showing an example of conductor patterns of individual layers when the impedance converting circuit is configured in a multilayer substrate. Although the conductor pattern of each layer, when in the direction shown in FIG. 20, is provided at the reverse side, each conductor pattern is indicated by a solid line. Also, although each linear conductor pattern has a predetermined line width, it is indicated by a simple solid line in this case.

A conductor pattern 73 is provided in the area indicated in FIG. 20 and at the reverse side of a base layer 51*a*, conductor patterns 72 and 74 are provided at the reverse side of a base layer 51*b*, and conductor patterns 71 and 75 are provided at the reverse side of a base layer 51*c*. A conductor pattern 63 is provided at the reverse side of a base layer 51*d*, conductor patterns 62 and 64 are provided at the reverse side of a base layer 51*e*, and conductor patterns 61 and 65 are provided at the reverse side of a base layer 51*f*. A conductor pattern 66 is provided at the reverse side of a base layer 51*g*, and a power-supply terminal 41, a ground terminal 42, and an antenna terminal 43 are provided at the reverse side of a base layer 51*h*. Dotted lines extending vertically in FIG. 20 represent via electrodes, which provide inter-layer connections between the corresponding conductor patterns. Although these via electrodes are, in practice, cylindrical electrodes having predetermined diameter dimensions, they are indicated by simple dotted lines in this case.

In FIG. 20, the right half of the conductor pattern 63 and the conductor patterns 61 and 62 constitute a first coil element L1*a*. Also, the left half of the conductor pattern 63 and the conductor patterns 64 and 65 constitute a second coil element L1*b*. Also, the right half of the conductor pattern 73 and the conductor patterns 71 and 72 constitute a third coil element L2*a*. Also, the left half of the conductor pattern 73 and the conductor patterns 74 and 75 constitute a fourth coil element L2*b*.

Figure 21:
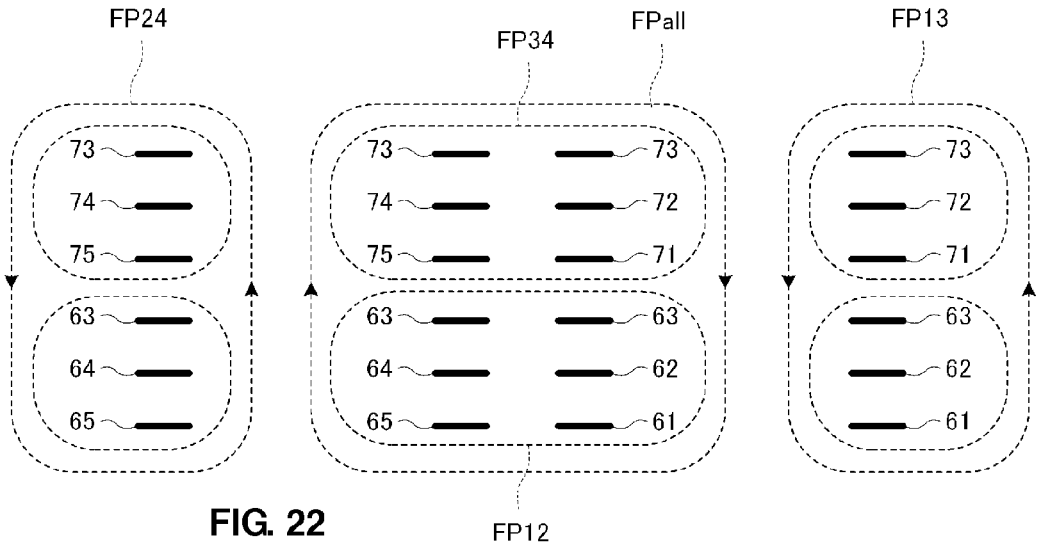
FIG. 21 is a diagram showing major magnetic fluxes that pass through the coil elements having the conductor patterns provided at the layers of the multiplayer substrate shown in FIG. 20.
Figure 22:
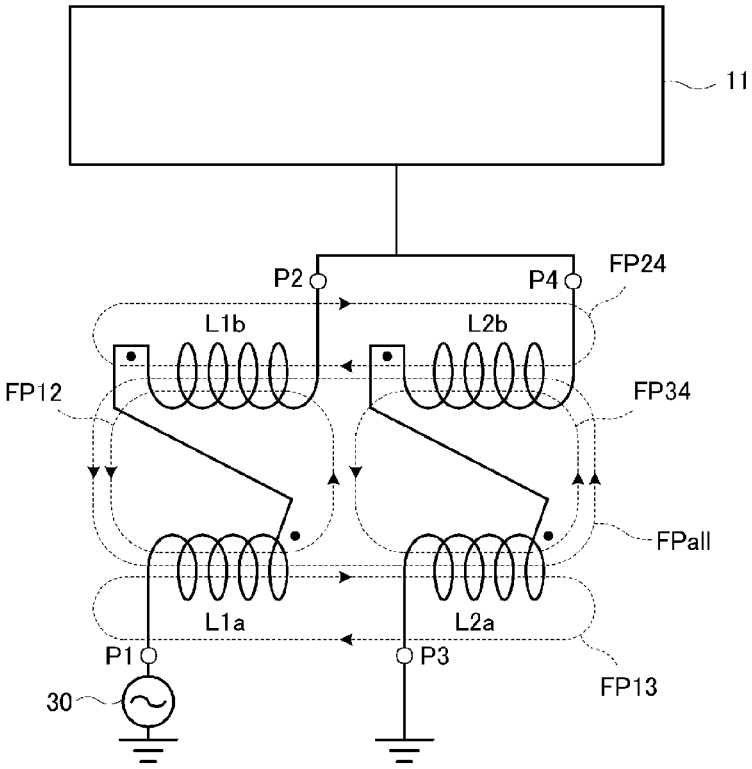
FIG. 22 is a diagram showing a relationship of magnetic couplings of four coil elements L1*a*, L1*b*, L2*a*, and L2*b* in the impedance converting circuit according to the ninth preferred embodiment of the present invention.

FIG. 21 is a diagram showing major magnetic fluxes that pass through the coil elements having the conductor patterns provided at the layers of the multiplayer substrate shown in FIG. 20. Also, FIG. 22 is a diagram showing a relationship of magnetic couplings of four coil elements L1*a*, L1*b*, L2*a*, and L2*b* in the impedance converting circuit according to the ninth preferred embodiment. As indicated by a magnetic flux FP12, the first coil element L1*a* and the second coil element L1*b* constitute a closed magnetic path, and as indicated by a magnetic flux FP34, the third coil element L2*a* and the fourth coil element L2*b* constitute a closed magnetic path. Also, as indicated by a magnetic flux FP13, the first coil element L1*a* and the third coil element L2*a* constitute a closed magnetic path, and as indicated by a magnetic flux FP24, the second coil element L1*b* and the fourth coil element L2*b* constitute a closed magnetic path. In addition, the four coil elements L1*a*, L1*b*, L2*a*, and L2*b* also constitute a closed magnetic path FPall.

Even with this configuration of the ninth preferred embodiment, since the inductance values of the coil elements L1*a* and L1*b* and the inductance values of the coil elements L2*a* and L2*b* are reduced by the respective couplings, the impedance converting circuit described in the ninth preferred embodiment also achieves advantages that are similar to those of the impedance converting circuit 25 in the seventh preferred embodiment.

Tenth Preferred Embodiment

Figure 23:
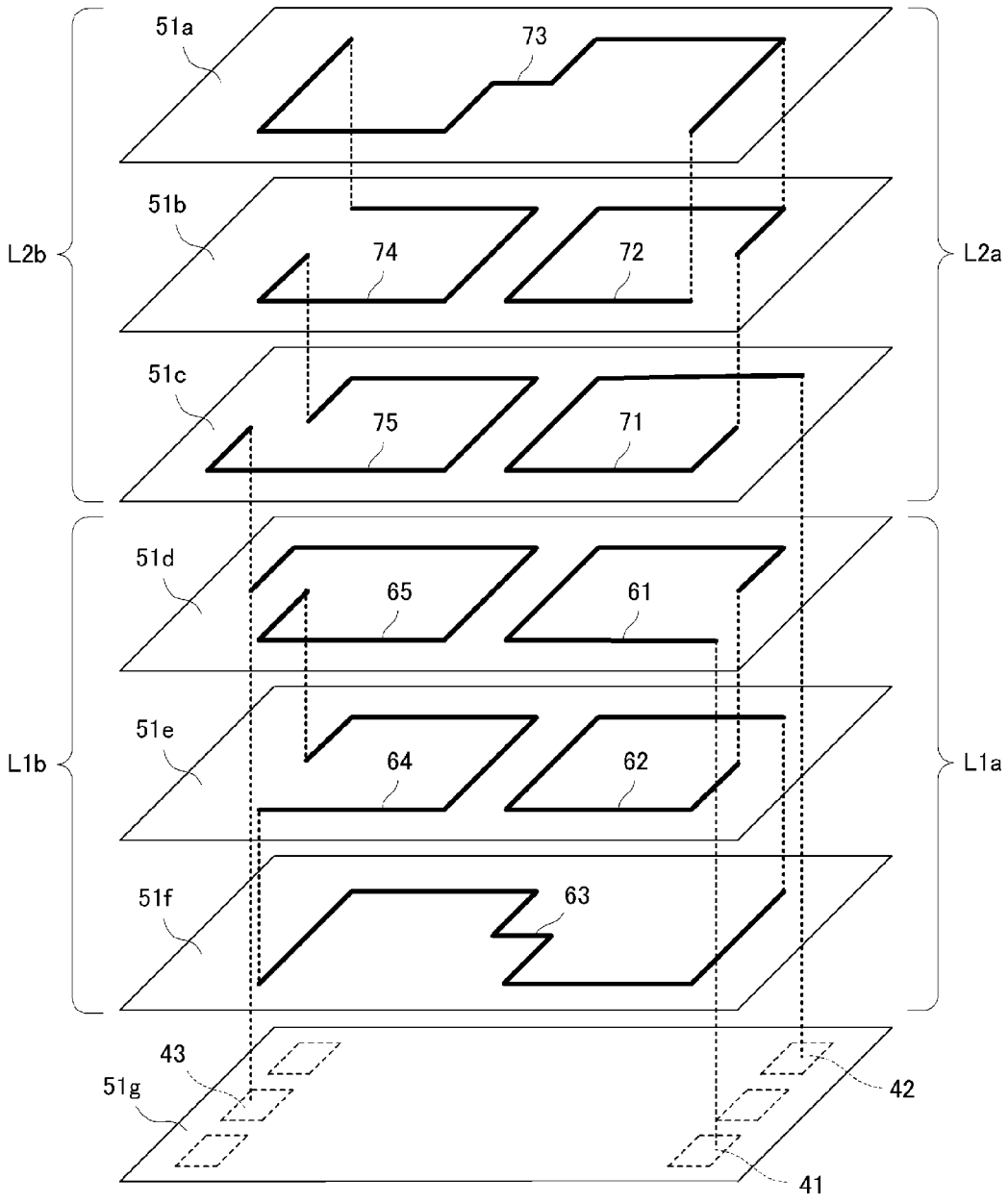
FIG. 23 is a view showing an example of conductor patterns of layers in an impedance converting circuit, configured in a multiplayer substrate, according to a tenth preferred embodiment of the present invention.

FIG. 23 is a view showing an example of conductor patterns of layers in an impedance converting circuit, configured in a multiplayer substrate, according to a tenth preferred embodiment. The layers are preferably constituted by magnetic sheets. Although the conductor pattern of each layer, when in the direction shown in FIG. 23, is provided at the reverse side of the magnetic sheet, each conductor pattern is indicated by a solid line. Also, although each linear conductor pattern has a predetermined line width, it is indicated by a simple solid line in this case.

A conductor pattern 73 is provided in the area indicated in FIG. 23 and at the reverse side of a base layer 51*a*, conductor patterns 72 and 74 are provided at the reverse side of a base layer 51*b*, and conductor patterns 71 and 75 are provided at the reverse side of a base layer 51*c*. Conductor patterns 61 and 65 are provided at the reverse side of a base layer 51*d*, conductor patterns 62 and 64 are provided at the reverse side of a base layer 51*e*, and a conductor pattern 63 is provided at the reverse side of a base layer 51*f*. A power-supply terminal 41, a ground terminal 42, and an antenna terminal 43 are provided at the reverse side of a base layer 51*g*. Dotted lines extending vertically in FIG. 23 represent via electrodes, which provide inter-layer connections between the corresponding conductor patterns. Although these via electrodes are, in practice, cylindrical electrodes having predetermined diameter dimensions, they are indicated by simple dotted lines in this case.

In FIG. 23, the right half of the conductor pattern 63 and the conductor patterns 61 and 62 constitute a first coil element L1*a*. Also, the left half of the conductor pattern 63 and the conductor patterns 64 and 65 constitute a second coil element L1*b*. Also, the right half of the conductor pattern 73 and the conductor patterns 71 and 72 constitute a third coil element L2*a*. Also, the left half of the conductor pattern 73 and the conductor patterns 74 and 75 constitute a fourth coil element L2*b*.

Figure 24:
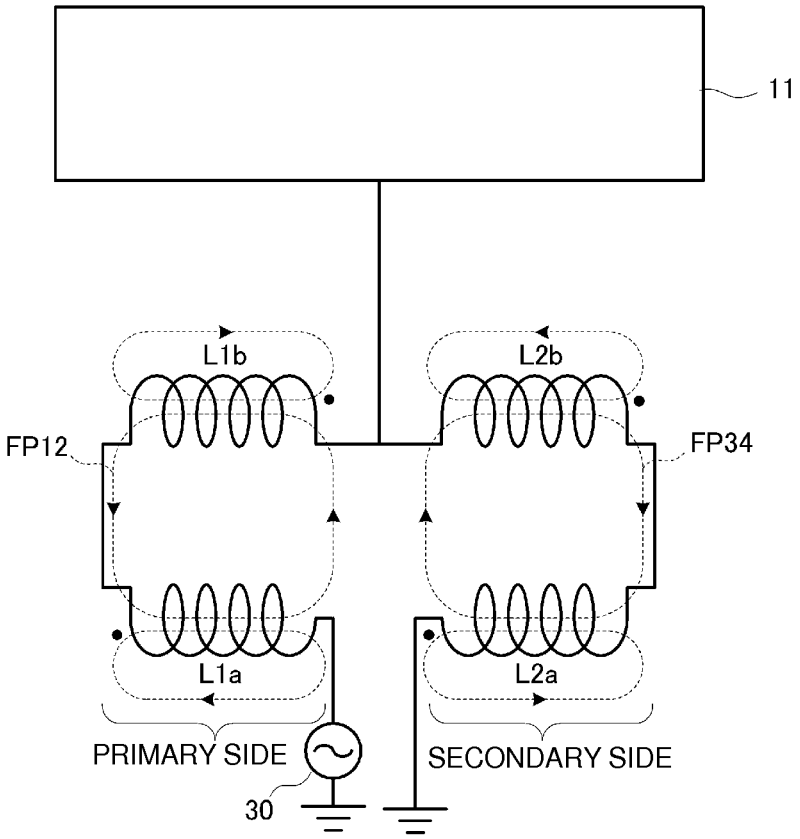
FIG. 24 is a diagram showing major magnetic fluxes that pass through the coil elements having the conductor patterns provided at the layers of the multiplayer substrate shown in FIG. 23.

FIG. 24 is a diagram showing a relationship of magnetic couplings of four coil elements L1*a*, L1*b*, L2*a*, and L2*b* in the impedance converting circuit according to the tenth embodiment. As shown, the first coil element L1*a* and the second coil element L1*b* constitute a first closed magnetic path (a loop represented by a magnetic flux FP12). Also, the third coil element L2*a* and the fourth coil element L2*b* constitute a second closed magnetic path (a loop represented by a magnetic flux FP34). The direction of the magnetic flux FP12 passing through the first closed magnetic path and the direction of the magnetic flux FP34 passing through the second closed magnetic path are opposite to each other.

Now, the first coil element L1*a* and the second coil element L1*b* are referred to as a "primary side" and the third coil element L2*a* and the fourth coil element L2*b* are referred to as a "secondary side". In this case, the power-supply circuit is connected to, in the primary side, a portion that is closer to the secondary side, as shown in FIG. 24. Thus, the potential in, in the primary side, the vicinity of the secondary side can be increased, so that the electric-field coupling between the coil element L1*a* and the coil element L2*a* increases and the amount of current resulting from the electric-field coupling increases.

Even with the configuration of the tenth preferred embodiment, since the inductance values of the coil elements L1*a* and L1*b* and the inductance values of the coil elements L2*a* and L2*b* are reduced by the respective couplings, the impedance converting circuit described in the tenth preferred embodiment also achieves advantages that are similar to those of the impedance converting circuit 25 in the seventh preferred embodiment.

Eleventh Preferred Embodiment

Figure 25:
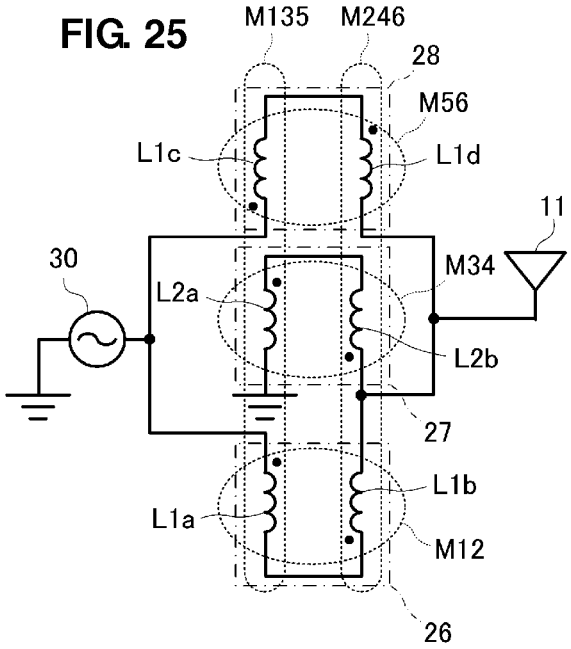
FIG. 25 is a diagram showing a relationship of magnetic couplings of four coil elements L1*a*, L1*b*, L2*a*, and L2*b* in the impedance converting circuit according to the ninth preferred embodiment of the present invention.

FIG. 25 is a circuit diagram of an impedance converting circuit according to an eleventh preferred embodiment. This impedance converting circuit includes a first series circuit 26 connected between a power-supply circuit 30 and an antenna element 11, a third series circuit 28 connected between the power-supply circuit 30 and the antenna element 11, and a second series circuit 27 connected between the antenna element 11 and ground.

The first series circuit 26 is a circuit in which a first coil element L1*a* and a second coil element L1*b* are connected in series. The second series circuit 27 is a circuit in which a third coil element L2*a* and a fourth coil element L2*b* are connected in series. The third series circuit 28 is a circuit in which a fifth coil element L1*c* and a sixth coil element L1*d* are connected in series.

In FIG. 25, an enclosure M12 represents coupling between the coil elements L1*a* and L1*b*, an enclosure M34 represents coupling between the coil elements L2*a* and L2*b*, and an enclosure M56 represents coupling between the coil elements L1*c* and L1*d*. An enclosure M135 also represents coupling of the coil elements L1*a*, L2*a*, and L1*c*. Similarly, an enclosure M246 represents coupling of the coil elements L1*b*, L2*b*, and L1*d*.

In the eleventh preferred embodiment, the coil elements L2*a* and L2*b* constituting a second inductance element is disposed so that they are sandwiched by the coil elements L1*a*, L1*b*, L1*c*, and L1*d* constituting the first inductance elements, to thereby suppress stray capacitance generated between the second inductance element and ground. As a result of the suppression of such capacitance component that does not contribute to radiation, the radiation efficiency of the antenna can be enhanced.

Figure 26:
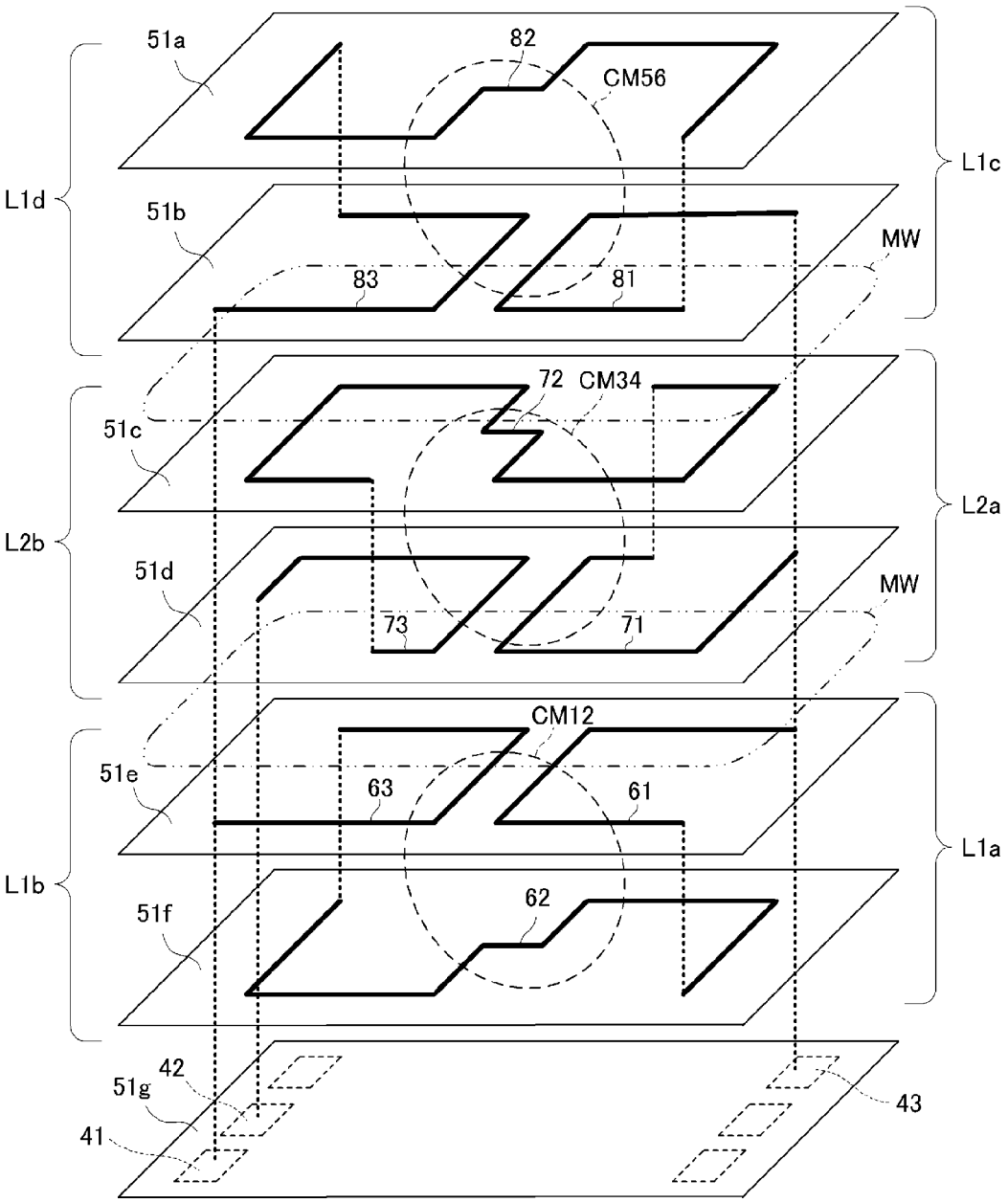
FIG. 26 is a view showing an example of conductor patterns of individual layers when the impedance converting circuit according to the eleventh preferred embodiment is configured in a multilayer substrate.

FIG. 26 is a view showing an example of conductor patterns of individual layers when the impedance converting circuit according to the eleventh preferred embodiment is configured in a multilayer substrate. The layers are preferably constituted by magnetic sheets. Although the conductor pattern of each layer, when in the direction shown in FIG. 26, is provided at the reverse side of the magnetic sheet, each conductor pattern is indicated by a solid line. Also, although each linear conductor pattern has a predetermined line width, it is indicated by a simple solid line in this case.

A conductor pattern 82 is provided in the area indicated in FIG. 26 and at the reverse side of a base layer 51*a*, conductor patterns 81 and 83 are provided at the reverse side of a base layer 51*b*, and a conductor pattern 72 is provided at the reverse side of a base layer 51*c*. Conductor patterns 71 and 73 are provided at the reverse side of a base layer 51*d*, conductor patterns 61 and 63 are provided at the reverse side of a base layer 51*e*, and a conductor pattern 62 is provided at the reverse side of a base layer 51*f*. A power-supply terminal 41, a ground terminal 42, and an antenna terminal 43 are provided at the reverse side of a base layer 51*g*. Dotted lines extending vertically in FIG. 26 represent via electrodes, which provide inter-layer connections between the corresponding conductor patterns. Although these via electrodes are, in practice, cylindrical electrodes having predetermined diameter dimensions, they are indicated by simple dotted lines in this case.

In FIG. 26, the right half of the conductor pattern 62 and the conductor pattern 61 constitute a first coil element L1*a*. Also, the left half of the conductor pattern 62 and the conductor pattern 63 constitute a second coil element L1*b*. Also, the conductor pattern 71 and the right half of the conductor pattern 72 constitute a third coil element L2*a*. Also, the left half of the conductor pattern 72 and the conductor pattern 73 constitute a fourth coil element L2*b*. Also, the conductor pattern 81 and the right half of the conductor pattern 82 constitute a fifth coil element L1*c*. Also, the left half of the conductor pattern 82 and the conductor pattern 83 constitute a sixth coil element L1*d*.

In FIG. 26, ellipses indicated by dotted lines represent closed magnetic paths. A closed magnetic path CM12 interlinks with the coil elements L1*a* and L1*b*. A closed magnetic path CM34 also interlinks with the coil elements L2*a* and L2*b*. A closed magnetic path CM56 also interlinks with the coil elements L1*c* and L1*d*. Thus, the first coil element L1*a* and the second coil element L1*b* constitute the first closed magnetic path CM12, the third coil element L2*a* and the fourth coil element L2*b* constitute the second closed magnetic path CM34, and the fifth coil element L1*c* and the sixth coil element L1*d* constitute the third closed magnetic path CM56. Planes denoted by long dashed double-short dashed lines in FIG. 26 represent two magnetic walls MW that are equivalently generated since the coils elements L1*a* and L2*a*, the coil elements L2*a* and L1*c*, the coil elements L1*b* and L2*b*, and the coil elements L2*b* and L1*d* couple to each other so that magnetic fluxes are generated in directions opposite to each other between the corresponding three closed magnetic paths. In other words, the two magnetic walls MW trap the magnetic flux of the closed magnetic path constituted by the coil elements L1*a* and L1*b*, the magnetic flux of the closed magnetic path constituted by the coil elements L2*a* and L2*b*, and the magnetic flux of the closed magnetic path constituted by the coil elements L1*c* and L1*d*.

As described above, the impedance converting circuit has a structure in which the second closed magnetic path CM34 is sandwiched by the first closed magnetic path CM12 and the third closed magnetic path CM56 in the layer direction. With this structure, the second closed magnetic path CM34 is sandwiched by two magnetic walls and is sufficiently trapped (the effect of trapping is increased). That is, it is possible to cause the impedance converting circuit to act as a transformer having a sufficiently large coupling coefficient.

Accordingly, the distance between the closed magnetic paths CM12 and CM34 and the distance between the closed magnetic paths CM34 and CM56 can be increased. Now, the circuit in which the series circuit constituted by the coil elements L1*a* and L1*b* and the series circuit constituted by the coil elements L1*c* and L1*d* are connected in parallel to each other is referred to as a "primary-side circuit" and the series circuit constituted by the coil elements L2*a* and L2*b* is referred to as a "secondary-side circuit". In this case, increasing the distance between the closed magnetic paths CM12 and CM34 and the distance between the closed magnetic paths CM34 and CM56 makes it possible to reduce the capacitance generated between the first series circuit 26 and the second series circuit 27 and the capacitance generated between the second series circuit 27 and the third series circuit 28. That is, the capacitance component of each LC resonant circuit that defines the frequency of a self-resonant point is reduced.

Also, according to the eleventh preferred embodiment, since the impedance converting circuit has a structure in which the first series circuit 26 constituted by the coil elements L1*a* and L1*b* and the third series circuit 28 constituted by the coil elements L1*c* and L1*d* are connected in parallel to each other, the inductance component of each LC resonant circuit that defines the frequency of the self-resonant point is reduced.

Both the capacitance component and the inductance component of each LC resonant circuit that defines the frequency of the self-resonant point are reduced, as described above, so that the frequency of the self-resonant point can be set to a high frequency that is sufficiently far from a frequency band used.

Twelfth Preferred Embodiment

In a twelfth preferred embodiment, a description is given of an configuration example, which is different from the configuration of the eleventh preferred embodiment, to increase the frequency of the self-resonant point of a transformer unit to a higher frequency than that described in the eighth to tenth preferred embodiments.

Figure 27:
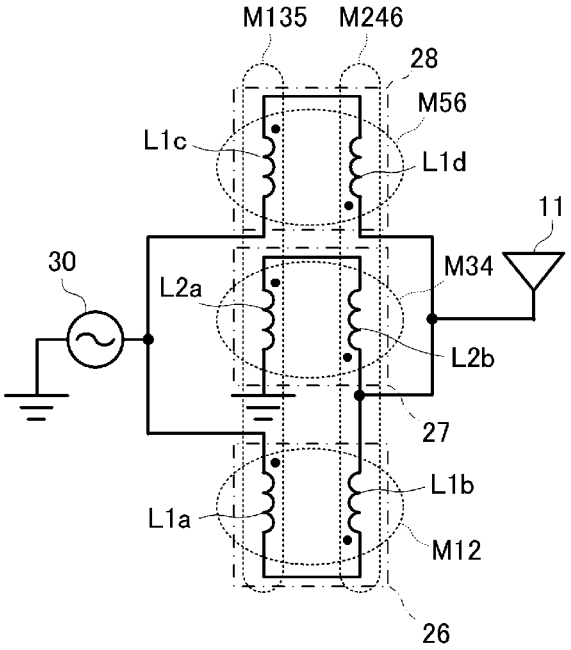
FIG. 27 is a circuit diagram of an impedance converting circuit according to a twelfth preferred embodiment of the present invention.

FIG. 27 is a circuit diagram of an impedance converting circuit according to a twelfth preferred embodiment. This impedance converting circuit includes a first series circuit 26 connected between a power-supply circuit 30 and an antenna element 11, a third series circuit 28 connected between the power-supply circuit 30 and the antenna element 11, and a second series circuit 27 connected between the antenna element 11 and ground.

The first series circuit 26 is a circuit in which a first coil element L1*a* and a second coil element L1*b* are connected in series. The second series circuit 27 is a circuit in which a third coil element L2*a* and a fourth coil element L2*b* are connected in series. The third series circuit 28 is a circuit in which a fifth coil element L1*c* and a sixth coil element L1*d* are connected in series.

In FIG. 27, an enclosure M12 represents coupling between the coil elements L1*a* and L1*b*, an enclosure M34 represents coupling between the coil elements L2*a* and L2*b*, and an enclosure M56 represents coupling between the coil elements L1*c* and L1*d*. An enclosure M135 also represents coupling of the coil elements L1*a*, L2*a*, and L1*c*. Similarly, an enclosure M246 represents coupling of the coil elements L1*b*, L2*b*, and L1*d*.

Figure 28:
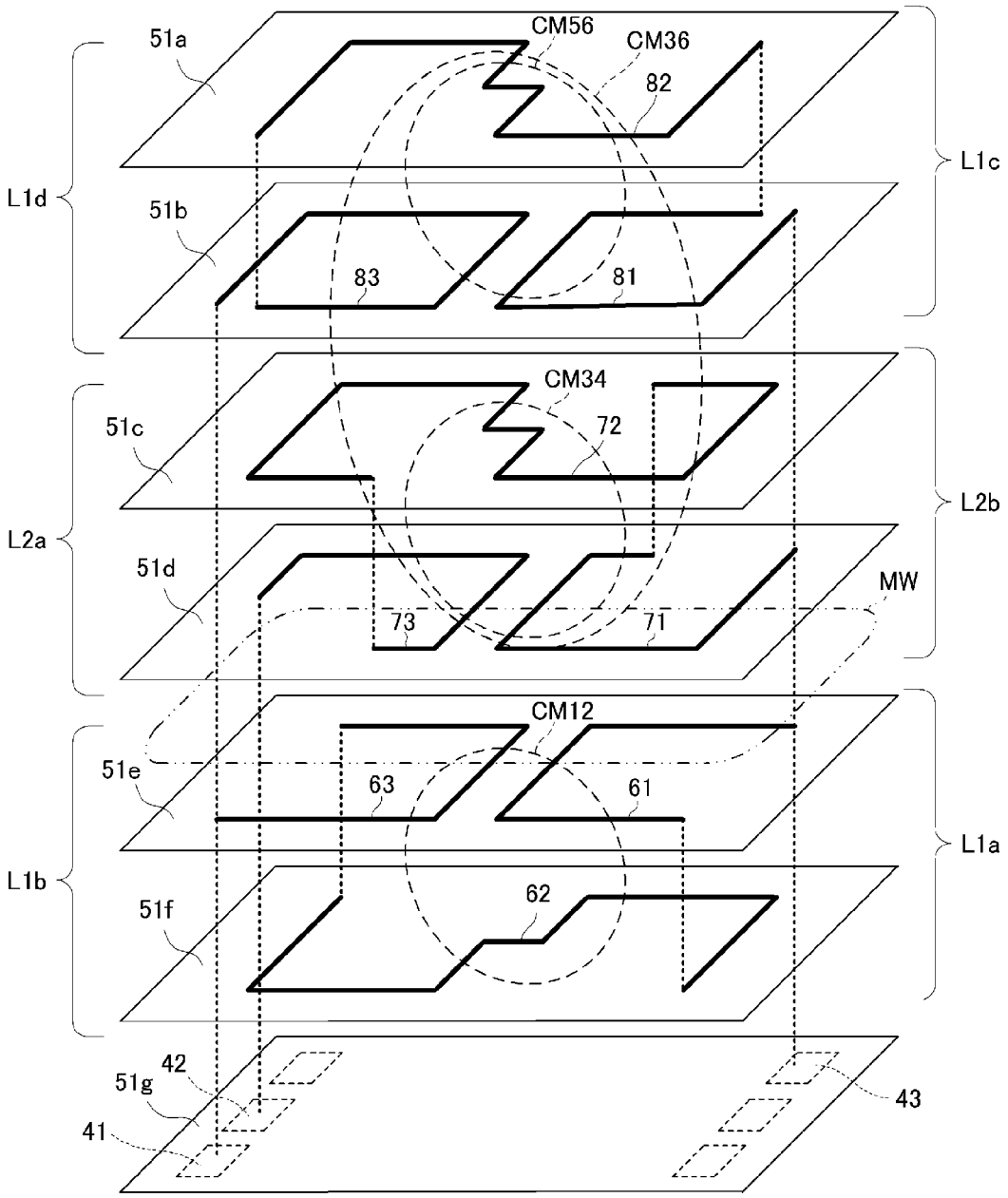
FIG. 28 is a view showing an example of conductor patterns of individual layers when the impedance converting circuit according to the twelfth preferred embodiment is configured in a multilayer substrate.

FIG. 28 is a view showing an example of conductor patterns of individual layers when the impedance converting circuit according to the twelfth preferred embodiment is configured in a multilayer substrate. The layers are preferably constituted by magnetic sheets. Although the conductor pattern of each layer, when in the direction shown in FIG. 28, is provided at the reverse side of the magnetic sheet, each conductor pattern is indicated by a solid line. Also, although each linear conductor pattern has a predetermined line width, it is indicated by a simple solid line in this case.

What is different from the impedance converting circuit shown in FIG. 26 is the polarity of the coil elements L1*c* and L1*d* constituted by the conductor patterns 81, 82, and 83. In the example in FIG. 28, a closed magnetic path CM36 interlinks with the coil elements L2*a*, L1*c*, L1*d*, and L2*b*. Thus, no equivalent magnetic wall is generated between the coil elements L2*a* and L2*b* and the coil elements L1*c* and L1*d*. Other configurations are the same as those described in the eleventh preferred embodiment.

According to the twelfth preferred embodiment, since the closed magnetic paths CM12, CM34, and CM56 shown in FIG. 28 are generated and also the closed magnetic path CM36 is generated, the magnetic flux caused by the coil elements L2*a* and L2*b* is absorbed by the magnetic flux caused by the coil elements L1*c* and L1*d*. Thus, even with the structure of the twelfth preferred embodiment, the magnetic flux hardly leaks, and consequently, it is possible to cause the impedance converting circuit to act as a transformer having a very large coupling coefficient.

In the twelfth preferred embodiment, both the capacitance component and the inductance component of each LC resonant circuit that defines the frequency of the self-resonant point are also reduced, so that the frequency of the self-resonant point can be set to a high frequency that is sufficiently far from a frequency band used.

Thirteenth Preferred Embodiment

In a thirteenth preferred embodiment, a description is given of another configuration example, which is different from the configurations of the eleventh and twelfth preferred embodiments, to increase the frequency of the self-resonant point of a transformer unit to a higher frequency than those described in the eighth to tenth preferred embodiments.

Figure 29:
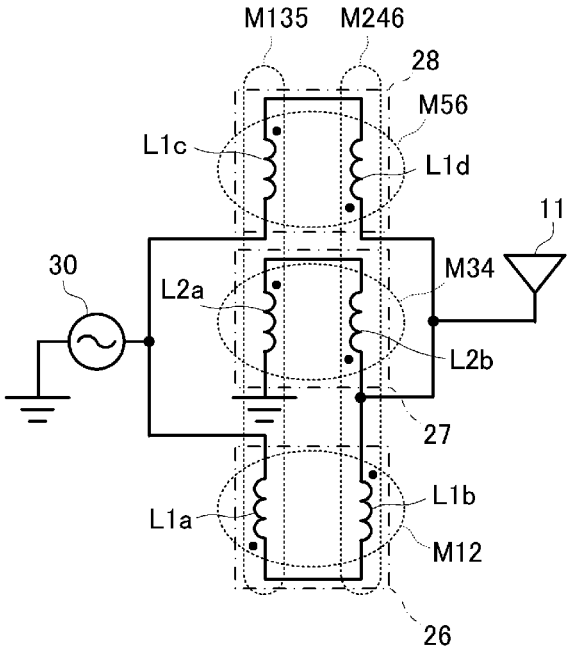
FIG. 29 is a circuit diagram of an impedance converting circuit according to a thirteenth preferred embodiment of the present invention.

FIG. 29 is a circuit diagram of an impedance converting circuit according to the thirteenth preferred embodiment. This impedance converting circuit includes a first series circuit 26 connected between a power-supply circuit 30 and an antenna element 11, a third series circuit 28 connected between the power-supply circuit 30 and the antenna element 11, and a second series circuit 27 connected between the antenna element 11 and ground.

Figure 30:
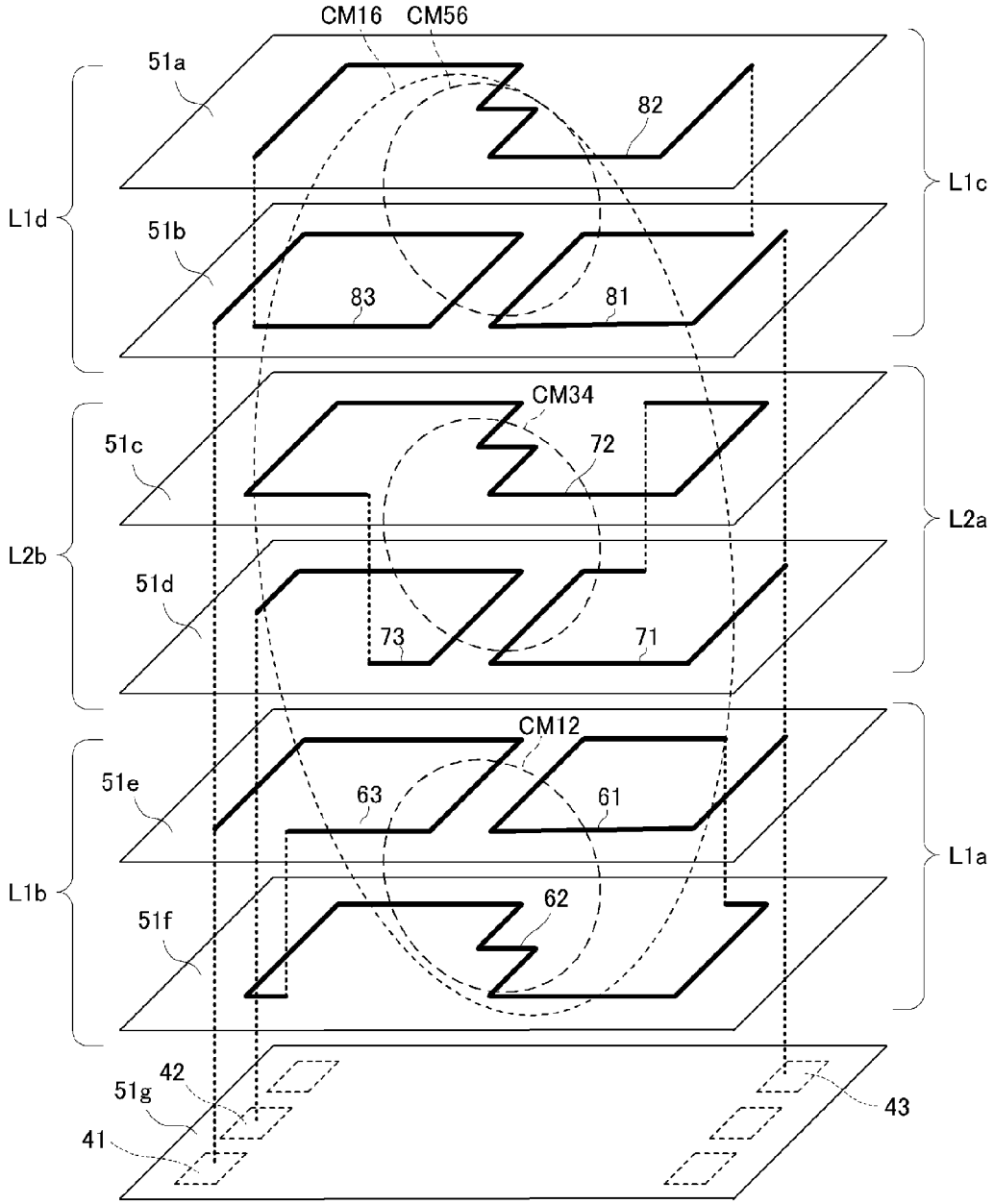
FIG. 30 is a view showing an example of conductor patterns of individual layers when the impedance converting circuit according to the thirteenth preferred embodiment is configured in a multilayer substrate.

FIG. 30 is a view showing an example of conductor patterns of individual layers when the impedance converting circuit according to the thirteenth preferred embodiment is configured in a multilayer substrate. The layers are preferably constituted by magnetic sheets. Although the conductor pattern of each layer, when in the direction shown in FIG. 30, is provided at the reverse side of the magnetic sheet, each conductor pattern is indicated by a solid line. Also, although each linear conductor pattern has a predetermined line width, it is indicated by a simple solid line in this case.

What are different from the impedance converting circuit shown in FIG. 26 are the polarity of the coil elements L1*a* and L1*b* constituted by the conductor patterns 61, 62, and 63 and the polarity of the coil elements L1*c* and L1*d* constituted by the conductor patterns 81, 82, and 83. In the example in FIG. 30, a closed magnetic path CM16 interlinks with all of the coil elements L1*a* to L1*d*, L2*a*, and L2*b*. Thus, in this case, no equivalent magnetic wall is generated. Other configurations are the same as those described in the eleventh and twelfth embodiments.

According to the thirteenth preferred embodiment, since the closed magnetic paths CM12, CM34, and CM56 shown in FIG. 30 are generated and also the closed magnetic path CM16 is generated, the magnetic flux caused by the coil elements L1*a* to L1*d* hardly leaks. As a result, it is possible to cause the impedance converting circuit to act as a transformer having a large coupling coefficient.

In the thirteenth preferred embodiment, both the capacitance component and the inductance component of each LC resonant circuit that defines the frequency of the self-resonant point are also reduced, so that the frequency of the self-resonant point can be set to a high frequency that is sufficiently far from a frequency band used.

Fourteenth Preferred Embodiment

In a fourteenth preferred embodiment, a description is given of an example of a communication terminal apparatus.

Figure 31A:
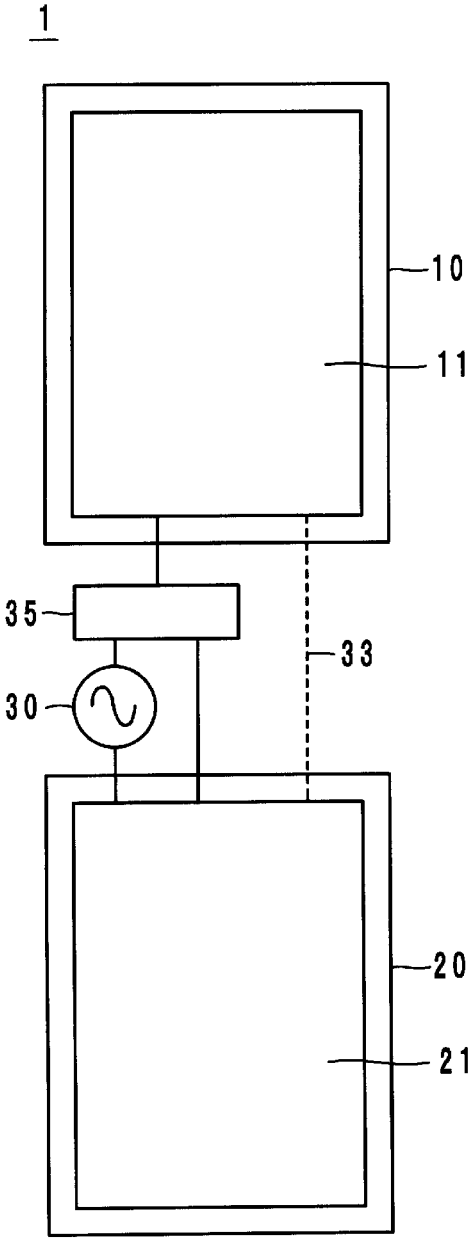
FIG. 31A is a configuration diagram of a communication terminal apparatus that is a first example of a fourteenth preferred embodiment and FIG. 31B is a configuration diagram of a communication terminal apparatus that is a second example.
Figure 31B:
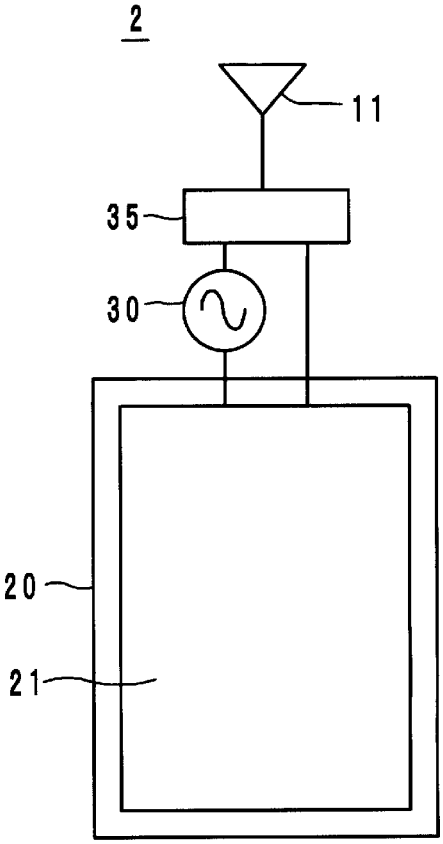

FIG. 31A is a configuration diagram of a communication terminal apparatus that is a first example of the fourteenth preferred embodiment and FIG. 31B is a configuration diagram of a communication terminal apparatus that is a second example. These communication terminal apparatuses are, for example, terminals for receiving high-frequency signals (470 MHz to 770 MHz) in a one-segment partial reception service (commonly called "one seg") for portable phones and mobile terminals.

A communication terminal apparatus 1 shown in FIG. 31A includes a first casing 10, which is a cover unit, and a second casing 20, which is a main unit. The first casing 10 is coupled to the second casing 20 by using a flip or slide mechanism. The first casing 10 is provided with a first radiation element 11 that also functions as a ground plate and the second casing 20 is provided with a second radiation element 21 that also serves as a ground plate. The first and second radiation elements 11 and 21 are preferably formed of conductive films including thin films, such as metallic foils, or thick films made of a conductive paste or the like, for example. Through differential power supply from a power-supply circuit 30, the first and second radiation elements 11 and 21 provide substantially equivalent performance as that of a dipole antenna. The power-supply circuit 30 includes a signal processing circuit, such as an RF circuit or a baseband circuit.

It is preferable that the inductance value of an impedance converting circuit 35 be smaller than the inductance value of a connection line 33 connecting two radiation elements and 21. This is because it is possible to reduce the influence that the inductance value of the connection line 33 has on the frequency characteristics.

In a communication terminal apparatus 2 shown in FIG. 31B, a first radiation element 11 is provided as an individual antenna. Various types of antenna elements, such as a chip antenna, a sheet-metal antenna, and a coil antenna, can be used as the first radiation element 11. For example, a linear conductor provided along the inner periphery or outer periphery of a casing 10 may also be used as the antenna element. A second radiation element 21 also functions as a ground plate for a second casing 20. Various types of antenna elements may also be used as the second radiation element 21, as in the first radiation element 11. Incidentally, the communication terminal apparatus 2 preferably is a straight-structure terminal, not a flip type or a slide type. The second radiation element 21 does not necessarily have to be one that functions sufficiently as a radiator, and the first radiation element 11 may also be one that behaves as the so-called "monopole antenna".

One end of a power-supply circuit 30 is connected to the second radiation element 21 and another end of the power-supply circuit 30 is connected to the first radiation element 11 via an impedance converting circuit 35. The first and second radiation elements 11 and 21 are also interconnected through a connection line 33. This connection line 33 serves as a connection line for electronic components (not shown) included in the first and second casings 10 and 20. The connection line behaves as an inductance element with respect to high-frequency signals, but does not directly affect the antenna performance.

The impedance converting circuit 35 is provided between the power-supply circuit 30 and the first radiation element 11 to stabilize frequency characteristics of high-frequency signals transmitted from the first and second radiation elements 11 and 21 or high-frequency signals received by the first and second radiation elements 11 and 21. Hence, the frequency characteristics of the high-frequency signals are stabilized without being affected by the shapes of the first radiation element 11 and the second radiation element 21, the shapes of the first casing 10 and the second casing 20, and the state of arrangement of adjacent components. In particular, in the flip-type or slide-type communication terminal apparatus, the impedances of the first and second radiation elements 11 and 21 are likely to vary depending on the opening/closing state of the first casing 10, which is the cover unit, relative to the second casing 20, which is the main unit. However, provision of the impedance converting circuit 35 makes it possible to stabilize the frequency characteristics of the high-frequency signals. That is, frequency-characteristic adjusting functions, including center-frequency setting, passband-width setting, and impedance-matching setting that are important matters for antenna design can be accomplished by the impedance converting circuit 35. Thus, with respect to the antenna element itself, it is sufficient to consider, mainly, directivity or a gain, thus facilitating the antenna design.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device, comprising:
a multiband-capable antenna element; and
an impedance converting circuit connected to the multiband-capable antenna element; wherein
the impedance converting circuit includes a transformer-type circuit in which a first inductance element and a second inductance element are transformer-coupled to each other via a mutual inductance M;
a first end of the first inductance element is connected to a power-supply circuit, a second end of the first inductance element is connected to ground, a first end of the second inductance element is connected to the multiband-capable antenna element, and a second end of the second inductance element is connected to ground; and
the mutual inductance M is greater than an inductance of the second inductance element.

2. The antenna device recited in claim 1, wherein the first inductance element includes a first coil element and a second coil element, the first coil element and the second coil element are interconnected in series, and conductor winding patterns are arranged to define a closed magnetic path.

3. The antenna device recited in claim 1, wherein the second inductance element includes a third coil element and a fourth coil element, the third coil element and the fourth coil element are interconnected in series, and conductor winding patterns are arranged to define a closed magnetic path.

4. The antenna device recited in claim 1, wherein
the first inductance element and the second inductance element are coupled to each other via a magnetic field and an electric field; and
when an alternating current flows in the first inductance element, a direction of a current flowing in the second inductance element as a result of the coupling via the magnetic field and a direction of a current flowing in the second inductance element as a result of the coupling via the electric field are the same.

5. The antenna device recited in claim 1, wherein, when an alternating current flows in the first inductance element, a direction of a current flowing in the second inductance element is a direction in which a magnetic wall is generated between the first inductance element and the second inductance element.

6. The antenna device recited in claim 1, wherein the first inductance element and the second inductance element include conductor patterns disposed in a laminate in which a plurality of dielectric layers or magnetic layers are laminated on each other and the first inductance element and the second inductance element are coupled to each other inside the laminate.

7. The antenna device recited in claim 1, wherein the first inductance element includes at least two inductance elements connected electrically in parallel, and the at least two inductance elements have a positional relationship such that the at least two inductance elements sandwich the second inductance element.

8. The antenna device recited in claim 1, wherein the second inductance element includes at least two inductance elements connected electrically in parallel, and the at least two inductance elements have a positional relationship such that the at least two inductance elements sandwich the first inductance element.

9. A communication terminal apparatus, comprising:
a multiband-capable antenna element;
a power-supply circuit; and
an impedance converting circuit connected between the multiband-capable antenna element and the power-supply circuit; wherein
the impedance converting circuit includes a transformer-type circuit in which a first inductance element and a second inductance element are transformer-coupled to each other via a mutual inductance M;
a first end of the first inductance element is connected to the power-supply circuit, a second end of the first inductance element is connected to ground, a first end of the second inductance element is connected to the multiband-capable antenna element, and a second end of the second inductance element is connected to ground; and
the mutual inductance M is greater than an inductance of the second inductance element.

10. An antenna device, comprising:
a multiband-capable antenna element; and
an impedance converting circuit connected to the multiband-capable antenna element; wherein
the impedance converting circuit includes a transformer-type circuit in which a first inductance element and a second inductance element are transformer-coupled to each other via a mutual inductance M; and
a first end of the first inductance element is connected to a power-supply circuit, a second end of the first inductance element is connected to the multiband-capable antenna element, a first end of the second inductance element is connected to the second end of the first inductance element and the multiband-capable antenna element, and a second end of the second inductance element is connected to ground.

11. The antenna device recited in claim 10, wherein the first inductance element includes a first coil element and a second coil element, the first coil element and the second coil element are interconnected in series, and conductor winding patterns are arranged to define a closed magnetic path.

12. The antenna device recited in claim 10, wherein the second inductance element includes a third coil element and a fourth coil element, the third coil element and the fourth coil element are interconnected in series, and conductor winding patterns are arranged to define a closed magnetic path.

13. The antenna device recited in claim 10, wherein the first inductance element and the second inductance element are coupled to each other via a magnetic field and an electric field; and when an alternating current flows in the first inductance element, a direction of a current flowing in the second inductance element as a result of the coupling via the magnetic field and a direction of a current flowing in the second inductance element as a result of the coupling via the electric field are the same.

14. The antenna device recited in claim 10, wherein, when an alternating current flows in the first inductance element, a direction of a current flowing in the second inductance element is a direction in which a magnetic wall is generated between the first inductance element and the second inductance element.

15. The antenna device recited in claim 10, wherein the first inductance element and the second inductance element include conductor patterns disposed in a laminate in which a plurality of dielectric layers or magnetic layers are laminated on each other and the first inductance element and the second inductance element are coupled to each other inside the laminate.

16. The antenna device recited in claim 10, wherein the first inductance element includes at least two inductance elements connected electrically in parallel, and the at least two inductance elements have a positional relationship such that the at least two inductance elements sandwich the second inductance element.

17. The antenna device recited in claim 10, wherein the second inductance element includes at least two inductance elements connected electrically in parallel, and the at least two inductance elements have a positional relationship such that the at least two inductance elements sandwich the first inductance element.

18. A communication terminal apparatus, comprising:

a multiband-capable antenna element;

a power-supply circuit; and an impedance converting circuit connected between the multiband-capable antenna element and the power-supply circuit; wherein the impedance converting circuit includes a transformer-type circuit in which a first inductance element and a second inductance element are transformer-coupled to each other via a mutual inductance M; and a first end of the first inductance element is connected to the power-supply circuit, a second end of the first inductance element is connected to the multiband-capable antenna element, a first end of the second inductance element is connected to the second end of the first inductance element and the multiband-capable antenna element, and a second end of the second inductance element is connected to ground.

* * * * *